US005254982A

United States Patent [19]

Feigenblatt et al.

[11] Patent Number: 5,254,982

[45] Date of Patent: Oct. 19, 1993

[54] ERROR PROPAGATED IMAGE HALFTONING WITH TIME-VARYING PHASE SHIFT

[75] Inventors: Ronald I. Feigenblatt, Dobbs Ferry; Carl G. Powell, Putnam Valley, both of N.Y.

[73] Assignee: International Business Machines Corporation, Armonk, N.Y.

[21] Appl. No.: 463,750

[22] Filed: Jan. 12, 1990

Related U.S. Application Data

[63] Continuation-in-part of Ser. No. 297,768, Jan. 13, 1989, abandoned.

[51] Int. Cl.[5] ..... G09G 5/10; G09G 3/36

[52] U.S. Cl. ..... 345/148; 345/89; 345/149

[58] Field of Search ..... 340/793, 784; 358/456, 358/457

[56] References Cited

U.S. PATENT DOCUMENTS

| | | | |
|---|---|---|---|
| 3,937,878 | 2/1976 | Judice . | |
| 3,953,668 | 4/1976 | Judice . | |
| 3,959,583 | 5/1976 | Judice et al. . | |
| 3,961,134 | 6/1976 | Jarvis . | |
| 3,997,719 | 12/1976 | Judice . | |
| 4,196,451 | 4/1980 | Pellar . | |
| 4,358,788 | 11/1982 | Burrowes | 340/793 |
| 4,507,685 | 3/1985 | Kawamura . | |
| 4,547,811 | 1/1985 | Ochi et al. . | |
| 4,622,595 | 11/1986 | Hisatake et al. . | |
| 4,651,293 | 3/1987 | Kato . | |
| 4,660,098 | 4/1987 | Wolcott . | |
| 4,698,691 | 10/1987 | Suzuki et al. . | |
| 4,700,235 | 10/1987 | Gall . | |
| 4,701,807 | 10/1987 | Ogino | 358/456 |
| 4,706,077 | 11/1987 | Roberts et al. . | |
| 4,733,230 | 3/1988 | Kurihara | 358/456 |
| 4,741,046 | 4/1988 | Matsunawa et al. | 358/456 |
| 4,742,400 | 5/1988 | Tsuji | 358/457 |
| 4,769,713 | 9/1988 | Yasui | 358/456 |
| 4,803,558 | 2/1989 | Hiratsuki | 358/457 |

FOREIGN PATENT DOCUMENTS

| | | |
|---|---|---|
| 0264302 | 4/1988 | European Pat. Off. . |
| 8807306 | 9/1988 | PCT Int'l Appl. . |

OTHER PUBLICATIONS

Digital Halftoning, The MIT Press, pp. 242-243, 268-269 and 340-343 prior to Jan. 13, 1989.

Multiple Error Diffusion Half-Toning, *The IAX Image Processing Ssytem: Reference Manual*, p. 104 1985.

Test Mode Color Mapping to Gray Scales, *CHIPS*, pp. 1 and 37 1988.

A Perceptual Basis For Comparing Pixel Selection Algorithms For Binary Color Matrix Displays, *SID 88 Digest*, pp. 435-438, Gomer et al. 1988.

(List continued on next page.)

*Primary Examiner*—Jeffery Brier

*Attorney, Agent, or Firm*—Scully, Scott, Murphy & Presser

[57] ABSTRACT

A method of displaying an image which builds upon the error propagation method for mosaic color displays propagates error between elements diagonally for a mosaic color display having diagonal rows consisting of monochromatic elements. In the method, called "pel interleaving", the "error" propagated into the first element in the diagonal row changes with each new image or frame processed. More specifically the error propagated into each diagonal's first element increases incrementally with each frame processed until it exceeds the maximum element intensity value, in which case it is started anew by subtracting the maximum value. The incremental increasing of this initial error, in the binary display case, leads to the spatial drift of "on" elements along the diagonals. If all preload values are equally likely, the time integrated ensemble of the displays approaches the exact contone image as the number of displayed images increases. Thus, if the processing is fast, so that the eye integrates a number of displayed images for the same input image, the display perceived using the present image approaches the actual contone of the input image.

50 Claims, 8 Drawing Sheets

OTHER PUBLICATIONS

An Adaptive Algorithm For Spatial Greyscale, *Proceedings of the S.I.D.* vol. 17/2 Second Quarter 1976, pp. 75–77 Floyd and Steinberg.

Halftoning Techniques Using Error Correction, *Proceedings of the S.I.D.*, vol. 27/4, 1986, pp. 305–308, Fawcett and Schrack.

D. Anastassiou and S. Kollias, "Digital Image Halftoning Using Neural Networks", pp. 1062–1069, in Visual Communications and Image Processing '88, SPIE vol. 1001, 1988.

K. G. Glenn and W. E. Glenn, "From vision science to HDTV-bridging the gap", p. 22ff., Information Display, Feb. 1987.

M. Rabbani, "Digital Image Compression and Restoration", course notes, SPSE/SPIE Conference on Electric Imaging, Los Angeles, 1988.

R. I. Feigenblatt, "Full-Color Imaging on Amplitude-Quantized Color Mosaic Displays", (RC 14345), SPSE/SPIE Conference on Electronic Imaging, Los Angeles, 1989.

Manual From Chips and Technologies, Inc. Publication No. CPI 32/8-88 pp. 1 and 37.

ERROR PROPAGATED IMAGE HALFTONING WITH TIME-VARYING PHASE SHIFT

This application is a continuation in part of co-pending application Ser. No. 07/297,768 filed on Jan. 13, 1990 now abandoned.

TECHNICAL FIELD

The present invention relates to multilevel display systems with display elements of relatively few intensity levels and, in particular, the adaptation of such systems for presentation of grey-scale images.

BACKGROUND OF THE INVENTION

A flat panel display system, such as a binary liquid crystal display (LCD), albeit having elements capable of displaying relatively few intensity values, does not have many of the disadvantages found in CRT monitor type display systems. Specifically, a binary LCD does not require an electron gun or a vacuum tube, and can therefore be made much thinner than a TV monitor. An LCD has low power and voltage requirements and consequently, gives off relatively little heat during operation, which makes it particularly suited to high density and portable uses. The hardware is relatively durable and can display the same image for a very long time without danger of damage to the elements.

However, a CRT display system can easily display relatively many intensity values between a minimum and maximum intensity value. In fact, the input to a CRT display system is typically an analogue intensity signal which is effectively quantized due to the noise associated with the signal, which limits finer differentiation of the input signal. The advantage of this finely quantized intensity capability is two-fold: First, the display gives a relatively accurate portrayal of the tone of the image. For example, the typical signal to noise ratios in video signals "limits" the elements on an analogue T.V. to be displayed at one of 256 values; nonetheless, this is a relatively finely quantized image, and the displayed value of each element is therefore a relatively close approximation of the part of the image being displayed. In other words, the display has good "grey-toning", or "halftoning". Second, and related to the first feature, the display has relatively good spatial resolution. Since the elements follow the intensity of the image well, changes in the intensity between adjacent pixels are also well represented. Therefore, the spatial resolution of the display is limited primarily by the physical separation of the elements.

The binary LCD and, more generally, displays with elements of relatively few intensity levels of an LCD nature, have certain disadvantages which mirror the advantages of the finely quantized display systems. For example, a binary LCD element represents the corresponding portion of the image by being either on or off. This is a poor representation if the image is grey at the part being represented. In other words, an LCD has inherently poor halftoning capability. Also, again related to the poor halftoning, the LCD display has relatively poor spatial resolution. Since the elements are either on or off, the shading of one image into another must be approximated by adjacent elements being either completely on or off. As a result, the shading will either be too abrupt or too spatially diffuse. In the latter case, the displayed image has resolution worse than the spatial separation of adjacent elements.

PRIOR ART

The prior art has considered the task of processing techniques for displaying an input signal adapted for systems with display elements of finely quantized intensity levels on a display with elements of relatively coarsely quantized intensity levels. As described below, the fundamental problem addressed by these prior art methods is that the number of intensity values an image element may take is greater than the number a display element may take. Therefore, the processing transforms a relatively finely quantized image element intensity value into one of a fewer number of display element intensity values. By making such a transformation, in most cases, the display element intensity value will differ from the image element intensity value.

For example, in the case of a standard TV image being displayed on a binary LCD screen, each image element intensity may take one of 256 values between a minimum and maximum intensity value, while the corresponding display element is either the minimum or maximum value. For an image element with intensity between the 1st and 256th value, displaying the display element at the maximum or minimum value is to some degree an error. If the image element has intensity corresponding to the 128th value, i.e., is halfway between the minimum and maximum intensity value, displaying the display element with the minimum or maximum intensity is a relatively large error. On the other hand, for an image element with intensity corresponding to the 3rd value, i.e., is very close to the minimum value, displaying the display element with minimum intensity is a very small error.

For many years processing techniques have been developed which attempt to subjectively display a grey image on a display with binary elements, thereby addressing the above problem. These techniques all derive from the premise that the eye will integrate the intensities of a number of closely spaced elements which are either light or dark, and therefore perceive a shade of grey.

U.S. Pat. No. 3,937,878 to Judice describes one method ("dither") applied to black and white imaging in a binary display system; the image to be reproduced is divided into a matrix of picture elements, each element corresponding to a respective cell of the display panel. A predetermined threshold value is assigned to each display cell. The threshold values repeat in a pattern, typically over 16 square ($4\times4$) elements, and are evenly spaced between a minimum and maximum image intensity value. If the intensity of any given picture element is greater than the threshold value assigned to the corresponding display cell, that cell is turned on, otherwise, it is maintained off.

In such a system, very dark regions of the image do not exceed even the lowest threshold in the 16 square elements, and therefore the displayed region is dark. Likewise, very light regions exceed even the highest threshold values, and all 16 square elements are therefore lit. For regions of intensity exactly between completely dark and completely light, 8 of the 16 thresholds will be surpassed, and consequently 8 elements will be lit and 8 will remain dark. The eye will integrate over this small region and perceive a grey intensity.

Another method of halftoning by error-propagation is described by Fawcett and Schrack in "Halftoning Techniques Using Error Correction", Proceedings of the Society for Information Display, 27(4), pp. 305-308 (1986).

In the error propagation methods for use with binary display devices, the starting point again is a spatially quantized image. The amount by which the display element exceeds or falls short of the corresponding image intensity value is not simply discarded, as in straight threshold processing, but is added to or subtracted from geometrically nearby image values which are to be quantized into display elements later. In the error propagation methods, therefore, halftoning is achieved by adjusting nearby elements to compensate for the excess or deficit in intensity of a given element.

The present invention takes error propagation one step further, applying the concepts described above to mosaic color displays. In a mosaic color display, the element immediately to the right of a given element is not necessarily the same color as the given element; therefore error cannot always be propagated to the next element processed physically. The closest unprocessed element of the same color is, for a mosaic of isochromatic diagonals, for example, the element beneath the element directly to right of the given element. Thus, in the error propagation method applied to such mosaic color, error is diffused diagonally among elements. The method is more complex to implement on a hardware level when the elements are processed horizontally corresponding to the standard raster order of video data. For such a case, the error of one element must be stored and retrieved when the diagonally adjacent element is processed.

A main problem with the prior art error propagation halftoning methods is poor performance in dark areas, especially when the display elements have only binary capacity. When the image gets dark, the "on" elements get sparse and become very noticeable individually. In the methods where error is propagated along a single path, linear or herring-bone-shaped artifacts can also be seen. Isolated "on" pixels in dark areas detract far more from image quality than isolated "off" pixels in light areas.

Furthermore, as described above, when faced with the complication presented by mosaic color displays, the techniques developed for black and white images must be specially adapted to succeed.

SUMMARY OF THE INVENTION

The present invention provides a processing method and system whereby color images with elemental regions of relatively finely quantized intensity values are displayed on an LCD-type mosaic color display with display elements of relatively few intensity values. The inventive method of displaying an image includes the basic error propagation method for mosaic color displays, described above. As described, that method propagates error between elements diagonally for the case where the mosaic color display is patterned such that diagonal rows consist of monochromatic elements. However, the basic method assumes the "error" propagated to the first element in the diagonal to be zero, or, more generally, a temporally stationary, position-independent constant. By an additional feature of the method of the present invention, called "pel interleaving", an "error" is propagated into the first element in the diagonal row that changes with each new image or frame processed. The "error" propagated into the first element in the diagonal row is also called the "preload value". More specifically, the "error" propagated into the first element of each diagonal increases incrementally with each frame processed until the "error" exceeds the maximum element intensity value. At that point, the error propagation starts over by subtracting the maximum value.

The incremental increasing of the preload error value associated with each diagonal, in the binary display case, leads to the spatial drift of "on" elements along the diagonals. This spatial drift of the "on" elements along the diagonals is "pel interleaving"; the result is the perception of a halftoned display since, if all preload values are equally likely, the time integrated ensemble of the displays approaches the exact contone image as the number of displayed images increases. Thus, if the processing is fast, so that the eye integrates a number of displayed images for the same input image, the display perceived using the present image approaches the actual contone of the input image.

The present invention also achieves color halftoning in the displayed image which is subjectively a high quality representation of the image. In addition, the present invention also uses the rapid succession of displayed images to achieve subjective high quality color halftoning in the display.

Further to the present invention, artifacts are eliminated in the method of error propagation by pel interleaving. For the binary case, rather than giving an element an "on" display intensity unconditionally when its image intensity value plus error value exceeds a threshold, the display image is turned "on" only if there are less than a certain number of "off" elements since the last "on" element. However, even if the element is kept "off" because the number of prior diagonal elements were "off", it is considered "on" for purposes of the determination for later elements in the diagonal.

DETAILED DESCRIPTION OF THE PREFERRED EMBODIMENT OF THE INVENTION

The present invention improves on the prior art by applying error propagation to mosaic color displays and systematically varying the error associated with the first element of each diagonal row along which error is propagated in a mosaic display with isochromatic diagonals. The systematic variation of the "error" propagated into the first element in the diagonal, or, equivalently, the error preload value, leads to the pel interleaving, or spatial drift of "on" elements along the diagonal in the binary case, wherein the time integration of the display images for a succession of images or frames approaches the actual contone of the images inputted. Furthermore, by suppression of isolated light pixels surrounded by dark regions, artifacts are eliminated. The present invention is not limited to mosaics with a pattern of isochromatic diagonals, although the following description focuses on the diagonal mosaic case.

The present invention has two facts: (1) halftoning for mosaic color displays using error propagation, and (2) halftoning using pel interleaving. In order to describe the present invention, certain preliminary concepts applying to error propagation must be described in some detail.

Figure 1:
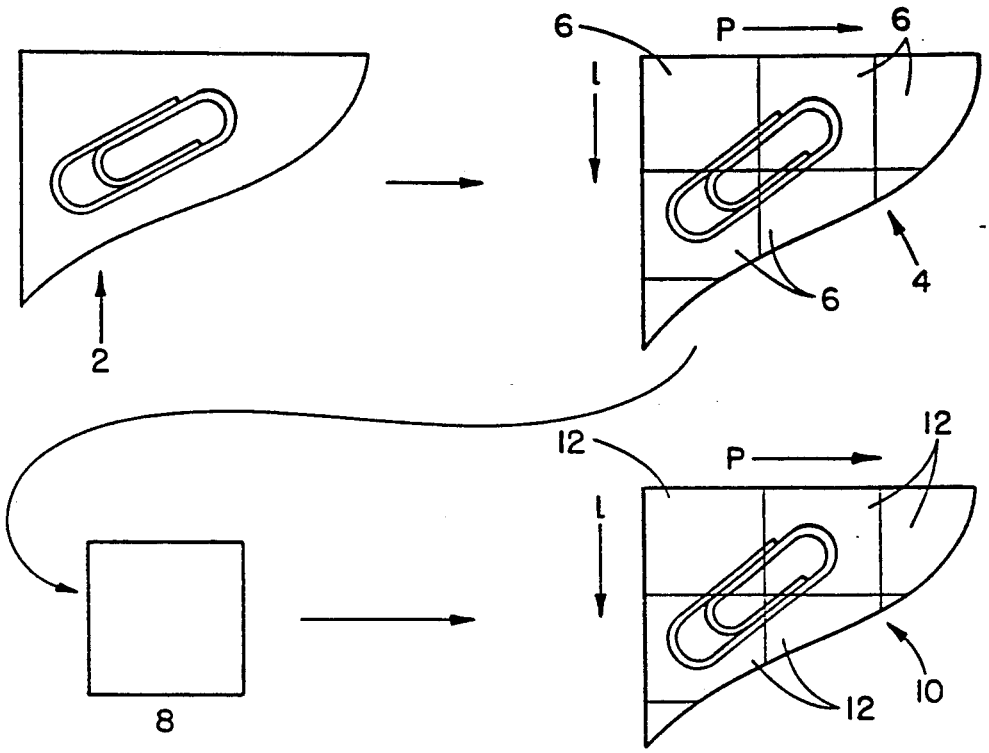
FIG. 1 is a flow diagram of the processing method of the present invention.

(a) Detailed Description of Preliminary Concepts Associated with Error Propagation Methods Any method of error propagation, including the present invention, can be represented by the flow diagram of FIG. 1. Referring to FIG. 1, a portion of an image 2 is shown, and divided into an image matrix 4, with matrix elements 6, of discrete intensity values. The matrix indices, l and p, maintain the spatial relationship of the image matrix to the image. The value of the image matrix elements can be assigned from a spatial and amplitude quantized version of a CRT video signal, for example.

The intensity value of each input matrix element 6 is in proportion to the light intensity of the corresponding region of the image 2 represented. The value of the intensity assigned to each image matrix element is discrete and finite, and the number of representative intensity values are relatively numerous with respect to the number of possible display intensity values, further discussed below. The number of discrete intensity values which each image element may take is defined as q.

The image matrix intensity values are then transformed by a processor 8 into a display matrix 10 each display matrix element 12 having an intensity. Each display matrix element 12 has a spatially corresponding image matrix element 6; therefore each display element intensity value is mapped one to one from the intensity of the corresponding image matrix element 6, plus an error value, described below.

The number of intensity values each display element can handle is discrete and quantized and is referred to as r. As described above, the present invention applies to the situation where the number of intensity values the display elements may handle is less than the number of intensity values the image elements may handle; equivalently, the value of r is less than q. Therefore the processing transforms a relatively finely quantized image element intensity value into one of a fewer number of display element intensity values. For the case of a standard TV image being displayed on a binary LCD screen, the image element intensity may be one of 256 intensity values while the corresponding display element is one of two possible values (on or off).

Figure 2:
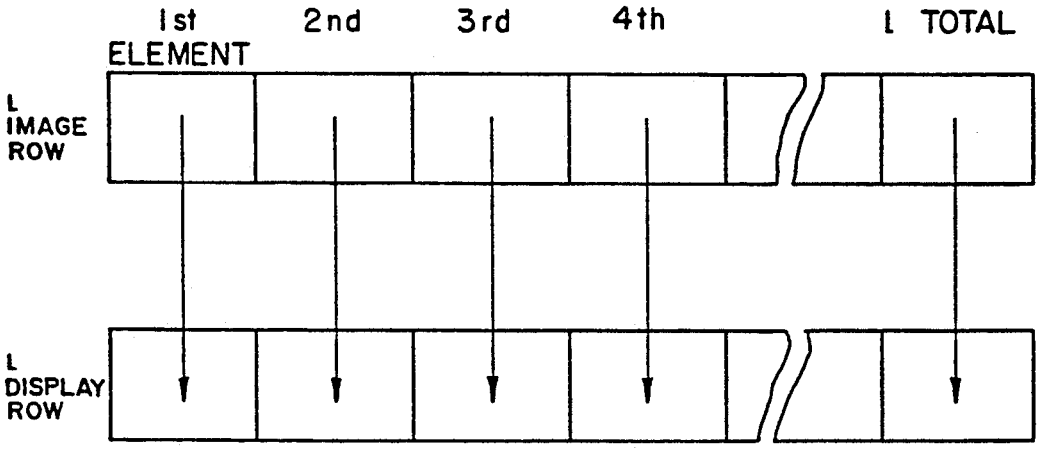
FIG. 2 is a schematic diagram illustrating the mapping of image elements in row 1 onto display elements in row 1.

Referring to FIG. 2, a schematic of one of the horizontal rows, 1, of the image and display elements of FIG. 1 are shown. The arrows show that the mapping of the present invention is one to one between corresponding matrix elements. Here, the processor 8 of FIG. 1 (not shown in FIG. 2) processes in real time. Such real time processing by processor 8 is not a necessary requirement for the term "error" propagation to apply to the display method, but such a feature is a preferred embodiment. That is, the processor maps an image element intensity into a display element intensity before the next image element intensity value arrives for input at the processor. If the processor mapped at a rate slower than the input rate of image element intensity values, the processor would have to store the backlogged values prior to processing, known to the art as "frame buffering". Therefore, in FIG. 2, the image intensity value of the first element in row 1 is mapped onto its corresponding display element before the image intensity value of the second element arrives at the processor. The same is true of the remaining sequence of elements of row 1 and all rows. Thus, the display image corresponds in time to the original image, inputted into the processor as a time sequence of image intensity values.

The sequential processing of all the elements in the 1 rows of FIG. 1 will therefore result in the display of the image 2 on the display 10 as a series of elements 12 with varying intensity values. By extension, a series of images divided into image elements, such as elements 6 in FIG. 1, could be processed sequentially, thereby displaying a nearly simultaneous series of displayed images 10 on the display. The display would then change at the same rate, thereby displaying a moving image. The frequency of the inputted image is defined as the frame rate. Since each inputted image is simply another sequence of intensity values corresponding to the image elements of the image, it follows from the above treatment of the processing speed that the frame rate is such that a complete image is physically processed and displayed before the next image elements arrive for processing.

It should be noted that a "frame" represents an "image" and consists of image elements with intensity values. Furthermore, a "new" frame may consist of the identical input signals of the prior frame, as when a display periodically refreshes for a constant image.

Figure 3:
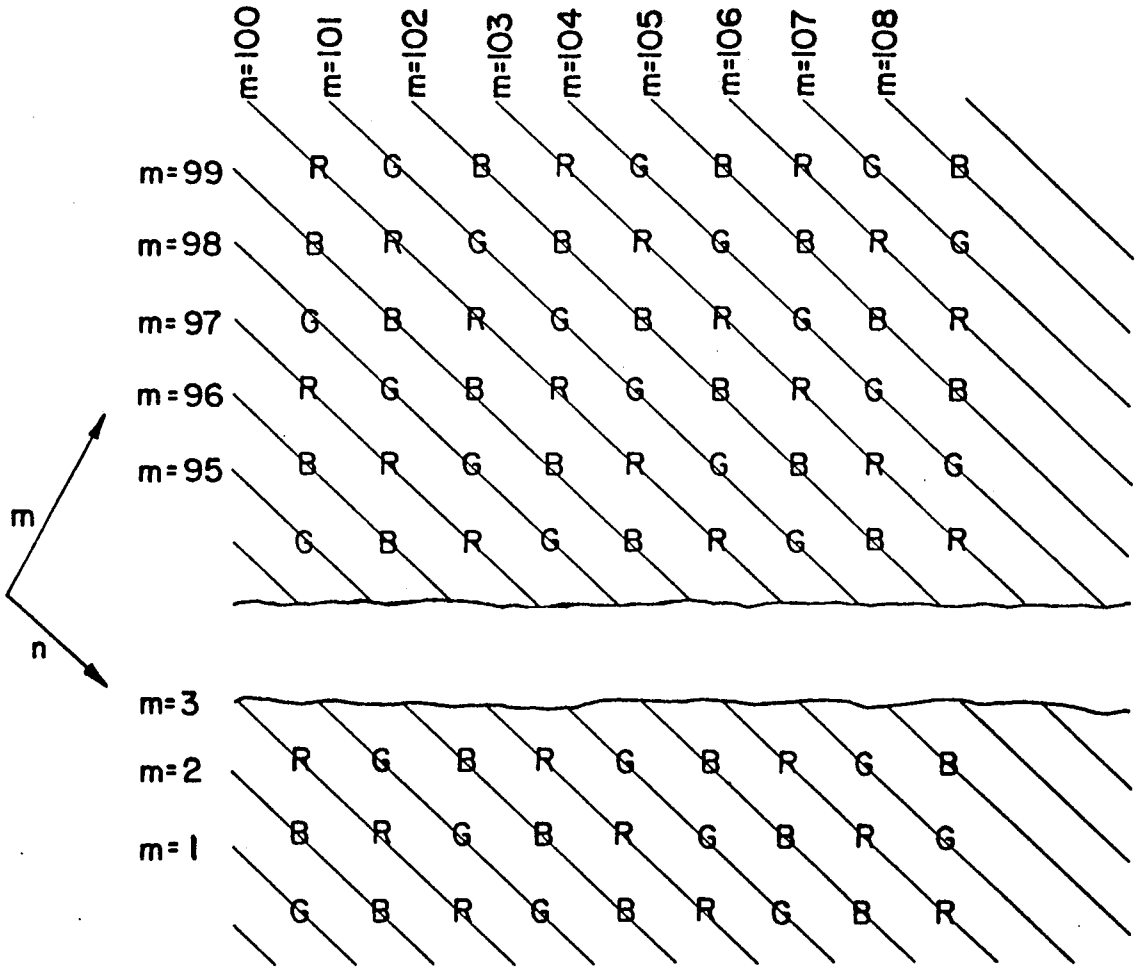
FIG. 3 is a schematic diagram of a standard mosaic color display, with isochromatic diagonals drawn through each display element.

(b) Detailed Description of the Basic Method of Error Propagation for Mosaic Color Displays Referring to FIG. 3, the pixel pattern of a mosaic color display with isochromatic diagonals is shown. The R corresponds to red pixels, G, green pixels and B, blue pixels. The colors correspond to the primary colors. An analogue input signal, or one finely amplitude quantized due to its inherent signal to noise ratio limitation, typically is continuous in time and consists of overlapping signals for each of the three primary color intensities representing the particular region of the analogue image. Thus, for each spatial quantization of the input image, i.e., temporal division of the input signal and assignment of a representative intensity value to each time interval, there are three discrete input amplitudes which correspond to the intensity level of the primary colors of the analogue image at the region corresponding spatially to the display element. These three input intensity values are of course discretely but finely quantized by the inherent signal to noise ratio limitation, discussed above.

The mapping of image intensity value onto display intensity value is therefore not as straightforward as in the monochromatic display case. The present invention contemplates two techniques for treatment of an image intensity value consisting of three primary intensity values to be mapped onto a display intensity value of one primary color. The first method effectively disregards the image intensity values of the two primaries which do not correspond to the display element primary. This method is advantageous when spatial resolution is the primary concern. The second method effectively groups temporally adjacent image intensity values in groups of three, averages the image intensity value for each primary over the three intervals, and maps the averaged image intensity value for each primary to the display element corresponding spatially to one of the image intensity values with the appropriate primary color. This method is advantageous when accurate contone is more important than spatial resolution.

The present invention incorporates both treatments of the input image signal. Since the invention applies in general, it is most convenient for the ensuing description to assume that the input signal has been previously processed according to one of the two methods described above so that a finely quantized image intensity value of color corresponding to the spatially corresponding display element primary color is to be mapped to that display element. With this in mind, the same mapping concepts described above with respect to FIGS. 1 and 2 can be applied to map a color image represented by a matrix of image elements with color intensities I(m,n) into a matrix of display elements with color intensities D(m,n), where I(m,n) must now be thought of as the resulting image intensity value of a single primary color, determined according to one of the two methods described above.

In FIG. 3, it is seen that parallel monochromatic diagonals may be drawn through all elements of the mosaic. In FIG. 3, the diagonals are numbered from the bottom left, m=1, up the left side of the mosaic, and then across the top. At the upper left hand corner, the diagonals are numbered such that m=100 is the diagonal in the extreme upper left-hand corner. Of course, the mosaic color display may have a larger or smaller height, and 100 is chosen for exemplery purposes only.

Figure 4:
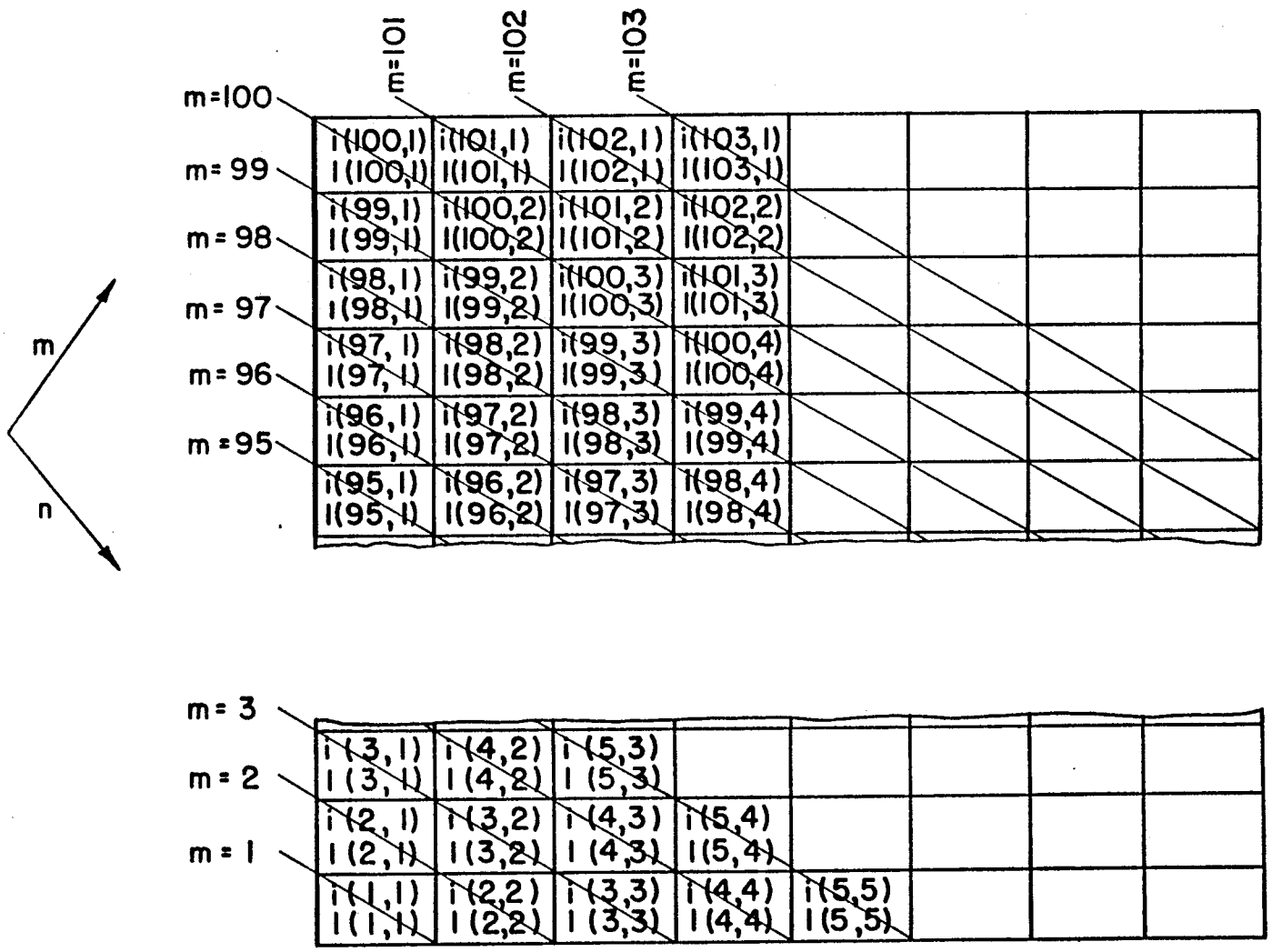
FIG. 4 is a schematic diagram of a mosaic color image where the elements are referenced corresponding to the isochromatic diagonals.

FIG. 4 shows an image matrix which has matrix elements referenced to the monochromatic pixel diagonals of the mosaic color display of FIG. 3. Since error is diffused diagonally between pixels in the method of error propagation for mosaic color display that the present invention improves upon, it is convenient to reference the matrix of image and display elements diagonally. Because of this, the elements in the "matrix" of FIG. 4 do not lie in orthogonal rows and columns as in standard matrices. Furthermore, each diagonal does not necessarily have the same number of elements as other diagonals. As a result, it is most appropriate to refer to FIG. 4 and related figures as m diagonals with each diagonal's elements numbered from 1 to $n_{total}$ and referenced as n. However, matrix terminology is used in the description due to the similarities of the elements as referenced in FIG. 4 with a standard matrix. Accordingly, each diagonal is numbered and is the first index of the matrix, and each element from the "top" of the diagonal to the "bottom" is numbered and is the second index of the matrix.

FIG. 4 therefore shows the diagonal rows numbered m, and the elements in the diagonal are numbered from top to bottom n=1, 2, . . . A portion of the image elements are shown referenced as i(diagonal number, position in diagonal), or i(m,n). For example, the second element in the 98th diagonal is referenced i(98,2). It is noted that each diagonal does not have the same number of elements; for example, row 1 has only one element, while row 5 has 5 elements. The maximum number of elements in a row, $n_{total}$, therefore, is a function of m. As discussed above, each image element i(m,n) will have an intensity value I(m,n) associated with it.

Not shown in FIG. 4, is an identical display matrix with matrix elements d(m,n) referenced diagonally exactly as the image elements of FIG. 4. Furthermore, each display element d(m,n) will have a display intensity value, referenced D(m,n), associated with it.

It is noted here, and discussed further below, that the physical embodiments typically process the elements in horizontal rows. Since error is propagated diagonally in the method of the present invention where the mosaic has isochromatic diagonals, the processor must be able to store the error of one element while intervening elements on the horizontal rows are processed, and retrieve the error when the diagonally adjacent element arrives for processing.

Figure 5:
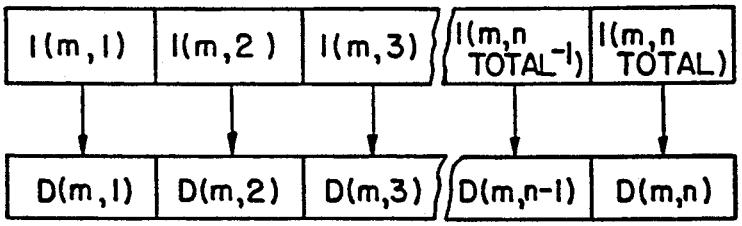
FIG. 5 is a horizontal schematic representation of the mapping of the mth diagonally referenced row of the representation of the present invention.

Referring to FIG. 5, the mth diagonal row of a mosaic color image matrix and display matrix are illustrated horizontally. The lines between image and display elements are representative of the one to one correspondence between the image and display matrix elements An image element, i(m,n), has an intensity value, I(m,n), which is one of q possible values. The display element d(m,n), has an intensity value, D(m,n), which can be one of r values. As described above, the possible number of image intensity values I(m,n) may take is greater than the number of display intensity values D(m,n) may take. In other words q>r. The r display intensity values are defined as A1, A2, . . . Ar; thus D(m,n) can equal A1, A2, . . . , or Ar.

To appreciate the present invention, consider the following simple mapping of image element intensity I(m,n) onto display element intensity D(m,n) for each matrix element: Between each of the r display intensity values A1, A2, . . . , Ar, there is a threshold value T1, T2, . . . , T(r−1); therefore T1 is between A1 and A2, T2 is between A2 and A3, . . . , Tx is between Ax and Ax+1, . . . , and T(r−1) is between Ar−1 and Ar. If an image intensity value I(m,n) is greater than Tx but less than T(x+1), the display intensity value D(m,n) is A(x+1). At the extrema, if I(m,n)<T1, then D(m,n)=A1, and if I(m,n)≧T(r−1), then D(m,n)=Ar.

Figure 6:
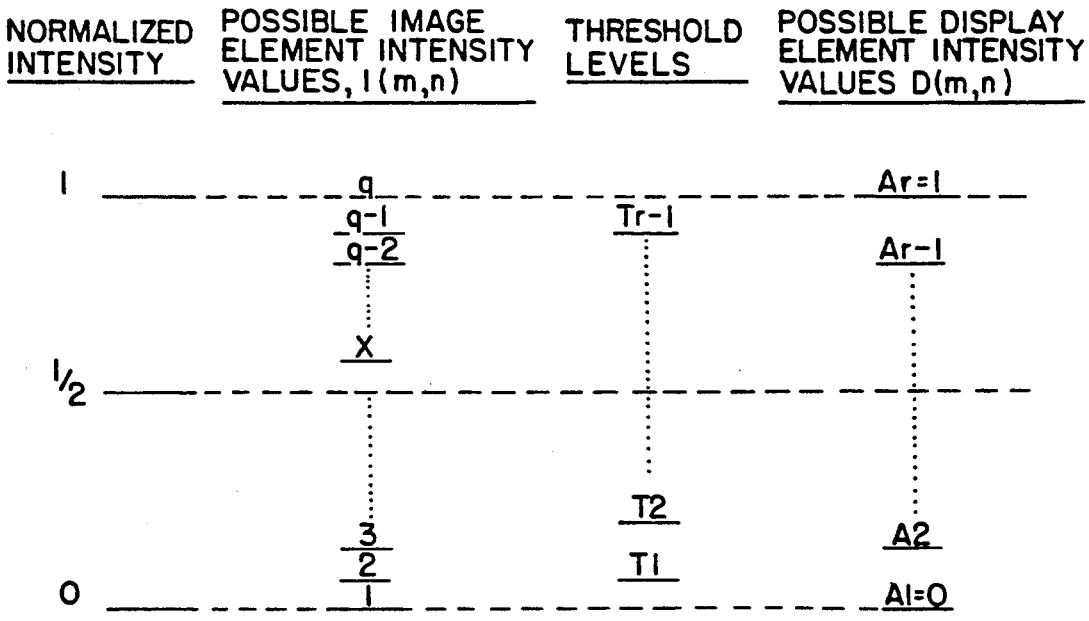
FIG. 6 is a diagram which shows the relative intensity values of the image elements, the display elements, and the processing threshold levels.

FIG. 6 illustrates the relative relationship between the q possible intensity values which I(m,n) may take, the r possible display values D(m,n) which range from A1 to Ar, and the r−1 threshold levels T1, T2, . . . , T(r−1). The intensity values I(m,n) are normalized to range from 0 to 1. It is seen that the q possible image intensity values each image element may take are more numerous than the r possible display intensity values D(m,n) each display element may take. In other words, the image elements have relatively finely quantized intensity values with respect to the display elements.

Figure 7:
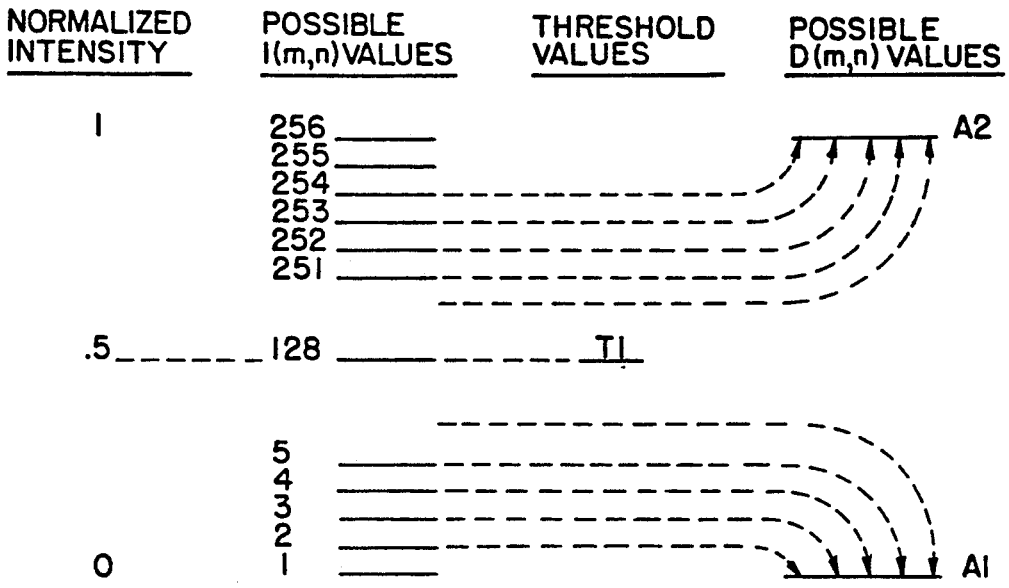
FIG. 7 is a diagram showing relative intensity values as in FIG. 6 where the image elements may take one of 256 intensity values on a standard T.V. display, and the display elements may take one of two intensity values on a standard binary LCD display.

There is an error associated with the mapping described above which is a fundamental characteristic of the number of display intensity values, r, being less than the number of image intensity values, q. FIG. 7 shows the case where the image elements take one of 256 possible intensity elements, as in a T.V. screen, and the display elements take on one of two possible intensity elements, as in a binary LCD display. In this case q=256, r=2, A1=0, A2=1 and T1 is chosen for example to be 0.50. It is shown by the dotted paths that all image intensity values between levels 1 and 256 will be displayed with an intensity of 0 or 1. Therefore, the mapping will result in the display element being too bright for image intensity values at levels 129–255, and too dark for image intensity values at levels 2–128.

Figure 8:
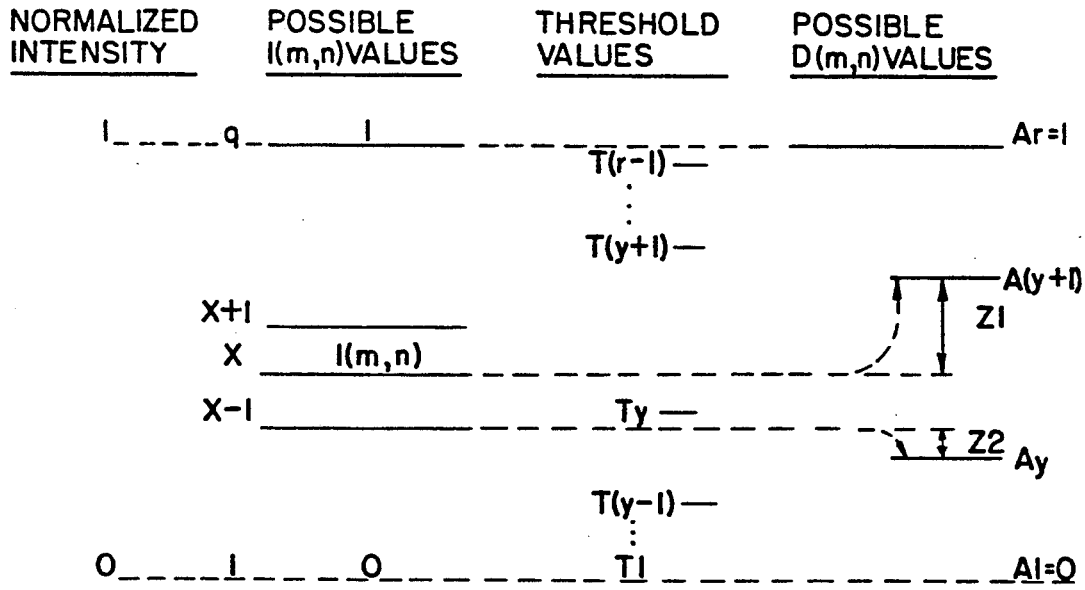
FIG. 8 is a diagram showing relative intensity values as in FIG. 6 also demonstrating schematically the mapping of an image element of intensity I(m,n).

This error is inherent in any system that maps a relatively finely quantized intensity value into a relatively coarsely quantized intensity value, not necessarily binary. FIG. 8 is an enlarged view of the possible intensity values near the xth possible image intensity value. The xth and (x+1)th possible image intensity values lie between threshold Ty and T(y+1); therefore if image element intensity value I(m,n) was at one of these intensity values, display element intensity value D(m,n) would have a mapped intensity value A(y+1), according to the simple algorithm described above. On the other hand, the (x−1)th possible image intensity value lies between Ty and T(y−1); therefore, according to the simple mapping algorithm, an image element at intensity level x−1 would have a displayed intensity value of Ay.

It is seen from FIG. 8 that if the image element is at the xth intensity level the displayed intensity D(m,n)=A(y+1) is greater than the image element intensity by an amount shown as z1. Similarly, if the image element is at the (x−1)th intensity level, the displayed intensity D(m,n)=Ay is less than the image element intensity by an amount shown as z2.

The present invention accounts for this mapping error by a method of error propagation. Error propagation generally refers to the adjustment of the value of neighboring display element intensities due to the over or under representation of the image element intensity, I(m,n), by the display element intensity, D(m,n). The over or under representation resulting from a mapping is the "error" propagated to the next image element. The nth element of the mth row is generally notated as (m,n) and is used interchangeably with i(m,n). The error propagated into the (m,n)th element of the matrix is E(m,n).

In an error diffusion method where the error is propagated to the next element in the mth row, i.e. from the (m,n−1)th element to the (m,n)th element, the amount of over or under representation resulting from the mapping of the image element intensity I(m,n−1) onto D(m,n−1) is subtracted or added, respectively, from the image element intensity I(m,n) before I(m,n) is mapped, using the mapping described above, onto display element intensity D(m,n).

For example, consider the mapping of the first image element intensity value in the mth row I(m,1) onto the corresponding display element intensity value D(m,1). Due to the q possible image intensity values being greater than the r possible display intensity values, described above, D(m,1) will normally be greater than or less than I(m,1) by some amount. If this error is propagated to the second element in the mth row, then E(m,2)=I(m,1)−D(m,1). Note that E(m,2) is negative if the display intensity value is greater than the image intensity value, and vice versa. Therefore, if there is an excess of displayed intensity, it is propagated as a negative number, and if there is a deficiency of intensity, it is propagated as a positive number.

Considering next the mapping of the second image element intensity of the mth row I(m,2) onto the corresponding display element intensity D(m,2), the method maps the sum of the image element intensity I(m,2) and propagated error E(m,2) onto the display element intensity D(m,2). In other words, the excess or deficiency of the displayed intensity of the first element is subtracted or added to the second image element intensity value before it is mapped onto the second display element intensity value.

The image element intensity value I(m,2) plus the propagated error E(m,2) which is mapped onto the display element intensity value is defined as the "adjusted image element intensity value" of the second image element in the mth row. It is the excess or deficit of the displayed intensity with respect to the adjusted intensity value which is propagated to the next element. In other words, E(m,3)=[I(m,2)+E(m,2)]−D(m,2). Furthermore, the adjusted image element intensity value of the 3rd element, I(m,3)+E(m,3), is mapped onto the corresponding display element intensity value, D(m,3).

The remaining elements in the mth row are similarly mapped. Therefore, for the nth element in the mth row, the adjusted image element intensity value I(m,n)+E(m,n) is mapped onto the corresponding display element intensity value D(m,n). The propagated error value E(m,n)=[I(m,n−1)+E(m,n−1)]−D(m,n−1).

(c) Detailed Description of the Pel Interleaving

Referring back to the first image element in row m, i(m,1), in FIG. 5, it was assumed there was no error value E(m,1), or, equivalently, E(m,1)=0. The present invention further provides a system in which the error value E(m,1) is arbitrarily chosen between 0 and the maximum value the image intensity value may attain. In accordance with the invention, the adjusted intensity value of the first element, I(m,1)+E(m,1), is mapped onto the corresponding display element D(m,1). Furthermore, the error which is propagated to the second element of the mth row is the adjusted intensity value of the first element minus the intensity value of the corresponding display element, or E(m,2)=[I(m,1)+E(m,1)]−D(m,1).

The processing for each element in each row of the pel interleaving feature of the present invention is formally the same. For any nth element I(m,n)+E(m,n) is mapped onto D(m,n). Also E(m,n)=[I(m,n−1)+E(m,n−1)]−D(m,n−1), except for E(m,1), which is a chosen value.

In the method "pel interleaving", the error preload value E(m,1) changes with each frame processed, whether the image is invarient or changes between frames. More specifically the error preload value for each diagonal increases incrementally with each frame processed until it exceeds the maximum element intensity value, in which case it is started anew by subtracting the maximum value. For the mosaic color display with isochromatic diagonals, the incremental increasing of the error associated with each diagonal's first element, in the binary display case, leads to the spatial drift of "on" elements along the diagonals. If all preload values are equally likely, the time integrated ensemble of the displays approaches the exact contone image as the number of displayed images increases. Thus, if the processing is fast, so that the eye integrates a number of displayed images for the same input image, the display perceived using the present image approaches the actual contone of the input image.

The present invention can therefore be summarized as a method of displaying an image comprising the steps of:

(a) providing an image comprising a plurality of image pixels i(m,n), m comprising the integers 1 to $m_{total}$, n comprising the integers 1 to $n_{total}$, $n_{total}$ a function of m, each image pixel i(m,n) having an intensity I(m,n) equal to at least one of q image intensity values, where q is at least equal to three, each image pixel having a position;

(b) providing a display comprising a plurality of display pixels d(m,n), each having a position corresponding to the position of image pixel i(m,n), and each display pixel d(m,n) being capable of emitting light with an intensity D(m,n) equal to one of r amplitude-ordered display intensity values A1,A2 . . . Ar, where r is an integer less than q, and Ax is the xth display intensity value;

(c) defining r−1 threshold values, (T1,T2, . . . T(r−1)), where Tx is the xth threshold value;

(d) defining an error function E(m,n), where E(m,n)=I(m,n−1)+E(m,n−1)−D(m,n−1) and E(m,1) for all m is a function of time and m only;

(e) for m=1 to $m_{total}$ and, for each m, for n=1 to $n_{total}$, displaying the display pixel d(m,n) with an intensity.

(i) D(m,n)=A1, if I(m,n)+E(m,n)≦T1, (ii) D(m,n)=Ar, if I(m,n)+E(m,n)≧T(r−1), or, (iii) for r>2 and T1≦I(m,n)+E(m,n)<T(r−1), D(m,n)=Ax where x is the value between 2 and r−1 which satisfies the condition Tx−1≦I(m,n)+E(m,n)<Tx.

While the above discussion and the following considerations focus primarily on a mosaic color display with isochromatic diagonals, the invention is not so limited. The invention is well suited for displays with isochromatic rows or columns, as well as other varients, such as a hexagonally-coordinated pattern, as long as the elements are referenced by matrix notation (m,n) wherein m references the groupings of elements for processing based on the particular mosaic pattern and n references the order of processing among elements in the mth group, respectively.

Furthermore, the sequence of input signals need not necessarily correspond to the mapping sequence of elements; equivalently, the mapping need not occur in real time. For example, the input signals for one frame may be stored in a storage matrix and accessed in the particular method's order of processing.

The method of error diffusion for the isochromatic diagonal display need not necessarily propagate the error from one display element directly into the adjacent element in the diagonal. A simple extension of the method described above would divide the error from one display element and diffuse it to a number of adjacent elements in the diagonal. Therefore, when processing the nth element in the mth row, the error value E(m,n) would equal the sum of a certain percentage of the error from a number of prior elements in the mth row. For example, the value of E(m,n) may equal ½ of the sum of the adjusted intensity of the prior two elements in the row minus their corresponding display elements. Equivalently E(m,n) would equal ½[[I(m,n−1)+E(m,n−1)]−D(m,n−1)] +½[[I(m,n−2)+E(m,n−2)]−D(m,n−2)].

By another extension, the error E(m,n) could be diffused to a number of nearby elements, not necessarily in the mth diagonal. Therefore, when processing the nth element in the mth diagonal, the error value E(m,n) would equal the sum of a certain percentage of error from a number of nearby prior elements in the mth, (m+3)th, (m+6)th, etc., diagonal since those diagonals have the same color as the (m,n)th element for the display with monochromatic diagonals. For example, the value of E(m,n) may equal ½[[I(m,n−1)+E(m,n−1)]−D(m,n−1)]+½[[I(m+3,n+2)+E(m+3, n+2)]−D(m+3,n+2)], where the element (m+3, n+2) is a next nearest element previously processed of the same color as the (m,n)th element.

For the "multielement" and "multibranch" methods just described, $$E(m, n) = \sum_{m'} \sum_{j} K(m, m', n, j) \times [I(m', j) + E(m', j) - D(m', j)]$$

where, (i) m' ranges among the references for the $m_{total}$ groupings of elements for processing, while j ranges among the references for each element in the m' group of elements (ii) K(m,m',n,j) is a propagation coefficient for the propagation of error from i(m',j) to i(m,n)

(iii) E(m,l) is a function of time and m.

It is noted that K(m,m',n,j) will be zero except for those relatively few pixels from which error is diffused It is also noted the above formulation is again not limited to mosaics with isochromatic diagonals, applying equally well to other patterned mosaics. The elements must of course be referenced by matrix notation (m,n), where m references the groupings of elements for processing based on the particular mosaic pattern, and n references the order of processing among elements in the mth group, respectively.

Figure 9:
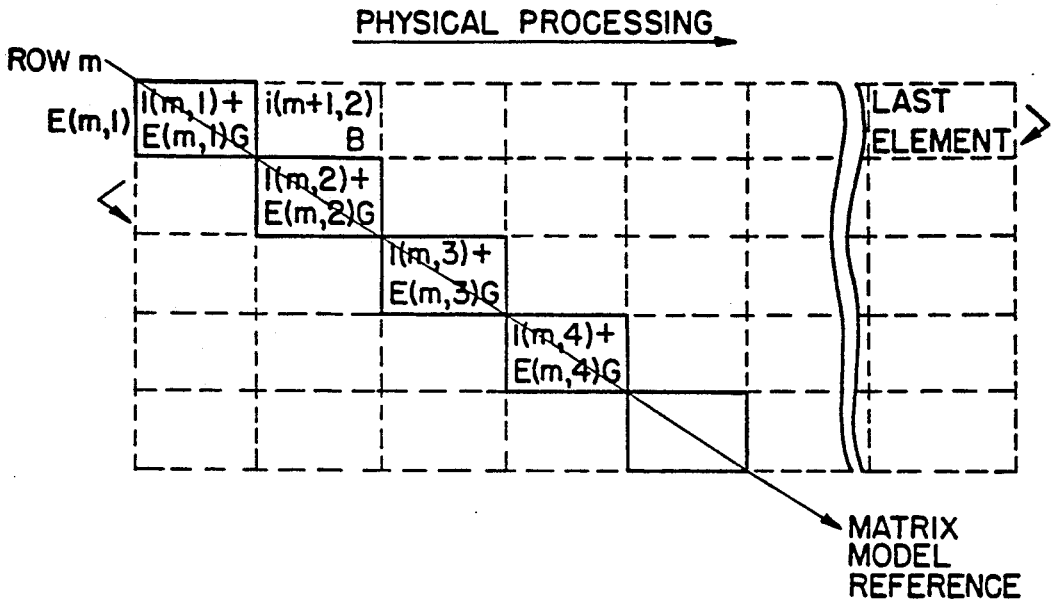
FIG. 9 is a schematic diagram illustrating the actual physical processing of elements in the present invention in relation to the diagonal matrix references.

FIG. 9 relates the diagonally referenced rows of the matrix model to the horizontal processing of a typical physical embodiment. The diagonal row, m, of FIG. 9 corresponds to one of the monochromatic diagonals of a mosaic color display along which error is propagated in the present invention. It is seen that the first image element in the mth diagonal row is the first element physically processed in the horizontal row in which it lies. Since E(m,1) is pre-selected as described above, I(m,1)+E(m,1) is processed onto the corresponding display element D(m,1), not shown in FIG. 9, in the physical process. The physical process then maps the image element in the horizontally adjacent position to the (m+1,1)th element, since the image and display electronic signals typically correspond to a standard raster display, as noted above. The physical processing continues until the last image element on the horizontal row is processed, and then begins to process the next horizontal row, beginning with image element (m−1,1). Only then is image element (m,2), the second element in the mth diagonal row, physically processed.

It is apparent from the above explanation and FIG. 9 that the number of elements in a horizontal row are processed in the physical embodiment between adjacent elements in a diagonal row. Therefore the physical embodiment must have a means to store and accurately access the value [I(m,1)+E(m,1)]−D(m,1)=E(m,2) so that it can map I(m,2)+E(m,2) after processing a number of intervening image elements. One way to achieve this storage is through a line buffer with storage capacity equal to the number of elements in a horizontal row. Since error must also be propagated to and from each of the intervening elements on the horizontal row, as they also lie on other diagonal rows, a line buffer the size of a horizontal row is well suited for this function.

Figure 9A:
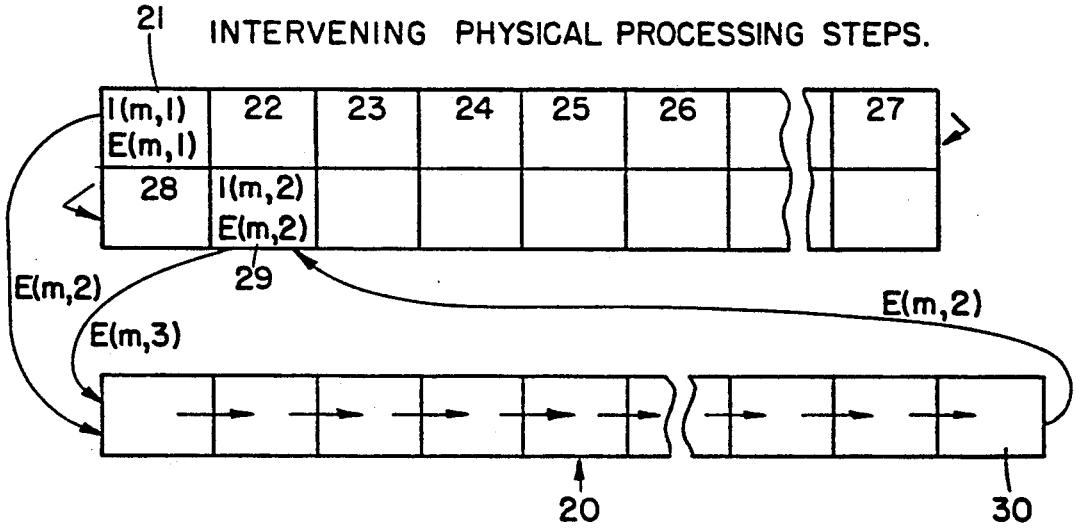
FIG. 9A is a schematic diagram illustrating how the value of E is propagated from one element to the diagonally adjacent element in an actual physical embodiment of the present invention.

The line buffer accomplishes this in a manner functionally analogous to a FIFO shift register of size equal to the number of elements in a horizontal row. Referring to FIG. 9A, the resulting value E(m,2) of processed element 21 is loaded into a buffer 20 before beginning the processing of the horizontally adjacent element 22. As each intervening raster-order elements 23–28 are processed, the value of E(m,2) moves toward the output 26 of the buffer 20 as data corresponding to the error of the intervening elements 23–28 is inputted and withdrawn from the buffer 20. When the second element of the mth diagonal row 29 is to be physically processed, the value E(m,2) is at the output 30 of the buffer 20 and can be accessed for processing. After processing, the resulting error, E(m,3), propagated to the next element in the mth row, not shown, is inputted into the buffer 20. While FIG. 9A shows a display with seven intervening elements, the above analogy applies to displays of more or less horizontal elements.

Figure 10:
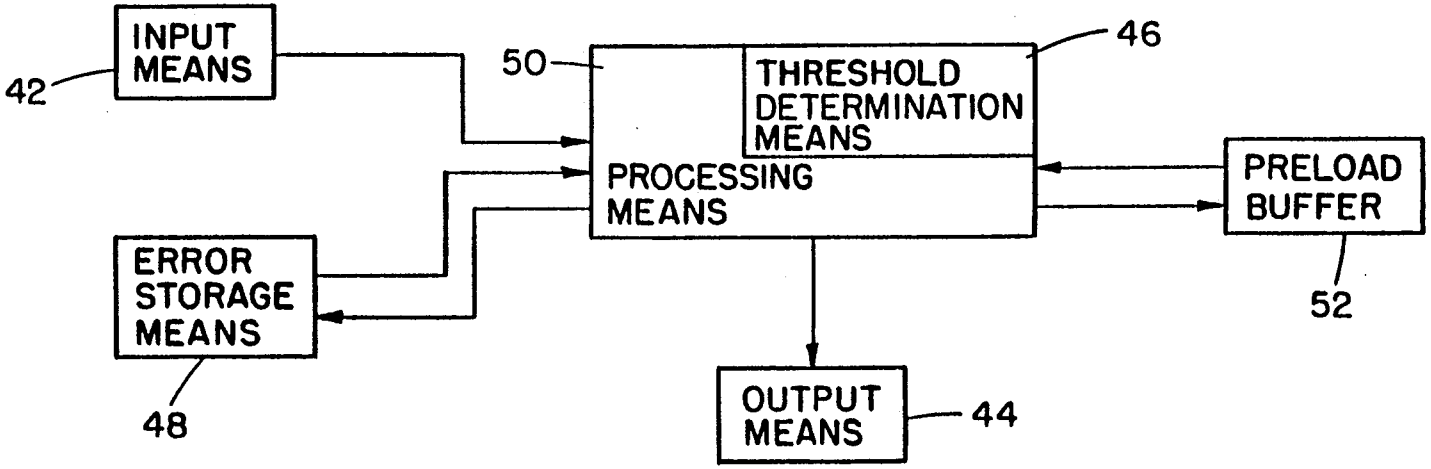
FIG. 10 is a block diagram of an embodiment of the present invention.

Referring to FIG. 10, one embodiment of the present invention is shown. The embodiment propagates error according to the method of the invention and has a means for storing the error as interim elements are processed. Since the sequence of inputted and outputted signals corresponds to the left to right, top to bottom sequence of a standard raster scan, it is now easiest to think of the elements referenced (l,p) as corresponding to the horizontal rows and vertical columns of the image elements. Briefly, the image element intensity value for the image element reference (l,p), I(l,p), is inputed through input means 42. If l=1 or p=1, then, in the current referencing of the elements, the element is at the top of a diagonal row, and the error value E(l,p) must be inputted according to the present invention. Therefore, preload buffer 52 is accessed, and E(l,p) is retrieved. If the element under consideration is not at the top of a diagonal, i.e., l≠1 and p≠1, then the appropriate error value, E(l,p), is retrieved from error storage means 48. However, E(l,p) is obtained, it is added to I(l,p) at processing means. Threshold determination means 46 is accessed with the sum I(l,p)+E(l,p), which determines which of the r−1 thresholds, described above, the sum I(l,p)+E(l,p) lies between. The appropriate threshold value is used by processing means 50, which outputs a value of display intensity D(l,p), at the output means 44 according to the threshold value. Due to the referencing of the elements horizontally and vertically, the diagonal element to i(l,p) is i(l+1, p+1). Therefore, processing means 50 also stores the value E(l+1, p+1)=[I(l,p)+E(l,p)]−D(l,p) at error storage means 48.

The error storage means can be line buffer of size equal to the number of vertical columns of image elements.

The above device can be applied to a device which propagates error diagonally in general, and is not limited to the specific mapping described above. The device will work for any determination of D(l,p) based on I(l,p) and E(l,p) and need not necessarily be the thresholding method of the present invention. Further, it will work for any value of E(l+1, p+1) determined from I(l,p), E(l,p) and D(l,p).

More specifically, the particular embodiment comprises of:

(a) an input means for receiving in a standard left to right top to bottom raster sequence a plurality of intensity encoded signals I(l,p) corresponding to a plurality of image pixels i(l,p) which each correspond to a position on the image, l comprising the integers 1 to $l_{total}$ and corresponding top to bottom to the $l_{total}$ horizontal rows of a raster scan, p comprising the integers 1 to $p_{total}$ and corresponding left to right to the $p_{total}$ vertical columns of a raster scan, where each intensity encoded signal I(l,p) corresponds to at least one of q image intensity values, where q is at least equal to three;

(b) an output means for outputting sequentially a plurality of intensity encoded signals D(l,p) corresponding to a plurality of display pixels d(l,p) each display pixel d(l,p) corresponding to the position of image pixel i(l,p), and each display intensity encoded signal D(l,p) corresponding to one of r amplitude-ordered display intensity values A1, A2, . . . , Ar, where r is an integer less than q and Ax is the xth display intensity value;

(c) An error storage means, for storing an error value E(l,p) corresponding to an intensity encoded signal at the input;

(d) A preload buffer for maintaining a preselected error value E(l,p) corresponding to a number of intensity encoded signals at the input;

(e) A processing means for mapping the intensity encoded signal at the input I(l,p) onto the intensity encoded signal at the output D(l,p) by (1) retrieving the value I(l,p) from the input means;

(2) if l=1 or p=1, obtaining the value E(l,p) from the preload buffer, (3) if l≠1 and p≠1, obtaining value E(l,p) from the error storage means, (4) determining the value D(l,p) based on the values of I(l,p) and E(l,p), (5) sending the value D(l,p) to said output means, (6) calculating the value E(l+1, p+1) based on I(l,p), D(l,p) and E(l,p), (7) storing E(l+1, p+1) in said error storage means.

Furthermore, it follows that the output means would be connected to a display with a color mosaic pattern, each element capable of taking on the intensity values A1, A2, . . . Ar.

An alternative embodiment of the device would propagate error to more than one adjacent element on the diagonal or other diagonals. This device would comprise:

(a) an input means for receiving in a standard left to right top to bottom raster sequence a plurality of intensity encoded signals I(l,p) corresponding to a plurality of image pixels i(l,p) which each corresponds to a position on the image, l comprising the integers 1 to $l_{total}$ and corresponding top to bottom to the $l_{total}$ horizontal rows of a raster scan, p comprising the integers l to $p_{total}$ and corresponding left to right to the $p_{total}$ vertical columns of a raster scan, where each intensity encoded signal I(l,p) corresponds to at least one of q image intensity values, where q is at least equal to three.

(b) an output means for outputting sequentially a plurality of intensity encoded signals D(l,p) corresponding to a plurality of display pixels d(l,p), each display pixel d(l,p) corresponding to the position of image pixel i(l,p), and each display intensity encoded signal D(l,p) corresponding to one of r amplitude-ordered display intensity values A1, A2, . . . , Ar, where r is an integer less than q, and Ax is the xth display intensity value;

(c) a partial error storage means for storing partial error values PE(l, l', p,p') corresponding to an intensity encoded signal I(l,p) at the input from prior elements (l', p');

(d) a buffer preload means for maintaining a preselected error value E(l,p) corresponding to a number of intensity encoded signal at the input;

(e) a processing means for mapping the intensity encoded signal at the input I(l,p) onto the intensity signal at the ouput D(l,p) by (1) retrieving the value I(l,p) from the input means, (2) if l=1 or p=1, obtaining the value E(l,p) from the buffer preload means, (3) if l≠1 and p≠1, obtaining the values PE(l, l',p,p') from the partial error storage means and summing the values of PE(l,l',p,p') to obtain E(l,p), (4) determining the value D(l,p) based on the values of I(l,p) and E(l,p), (5) sending the value D(l,p) to the output means, (6) calculating the partial error values PE(a,l,b,p), where (a,b) are the elements to which error is propagated from (l,p), (7) storing said partial error values PE(a,l,b,p) in said partial error storage means, for all (a,b).

In this embodiment, the partial error storage means could be a number of line buffers.

Figure 10A:
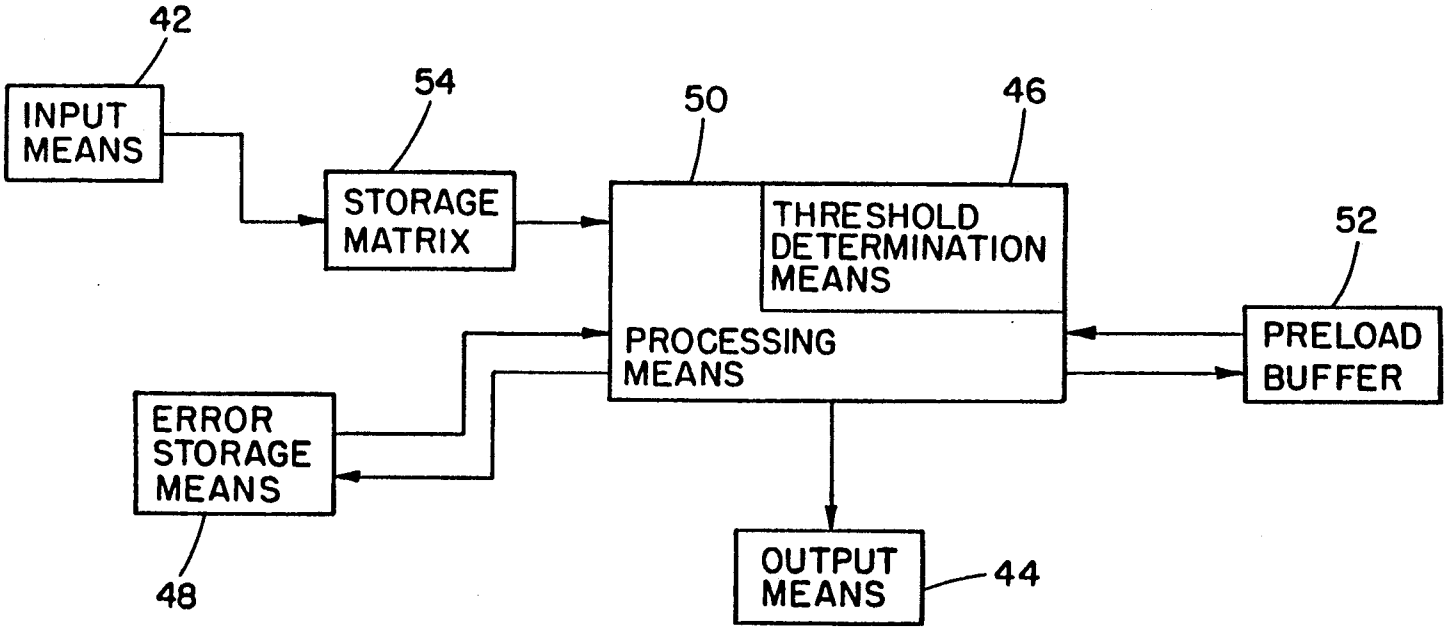
FIG. 10A is a block diagram of another embodiment of the present invention.

More generally, the device would receive input signals in a sequence, not necessarily a standard raster sequence, and map them according to a different sequence. The device would then require a storage matrix 54 between input means 42 and processing means 50, as shown in FIG. 10A. Such a device would therefore comprise:

(a) an input means for receiving a plurality of intensity encoded signals I(l,p) corresponding to a position on the image, l comprising the integers 1 to $l_{total}$ and referencing $l_{total}$ groupings of elements for processing, p comprising the integers 1 to $p_{total}$ and referencing the elements in the lth group according to their sequence of processing, $p_{total}$ a function of m, where each intensity encoded signal I(l,p) corresponds to at least one of q image intensity values, where q is at least equal to three.

(b) a matrix storage means where the input image intensity values of a complete frame may be stored and accessed;

(c) an input means for outputting sequentially a plurality of intensity encoded signals D(l,p) corresponding to the position of input image intensity value I(l,p), each display intensity encoded signal D(l,p) corresponding to one of r amplitude-ordered display intensity values A1,A2 . . . Ar where r is an integer less than q, and Ax is the xth display intensity value;

(d) a partial error storage means for storing partial error values PE(l,l',p,p') corresponding to an intensity encoded signal (l,p) being processed from elements (l',p');

(e) a buffer preload means for maintaining a preselected error value E(l,p) corresponding to a number of intensity encoded signals processed;

(f) a processing means for mapping the intensity encoded signals I(l,p) onto the intensity signal at the output by (1) retrieving a value I(l,p) from the matrix storage means, (2) if l=1 or p=1, obtaining the value E(l,p) from the buffer preload means, (3) if l≠1 or p≠1, obtaining the values PE(l,l',p,p') for all l' and p' from the partial error storage means and summing the values of PE(l,l', p,p') to obtain E(l,p), (4) determining the value D(l,p) based on the values of I(l,p) and E(l,p), (5) sending the value D(l,p) to the output means, (6) calculating the partial error values PE(a,l,b,p), where (a,b) are the elements to which error is propagated from (l,p), (7) storing said partial error values PE(a,l,b,p) in said partial error storage means for all (a,b).

The above device can be applied to mosaic color patterns other than those with isochromatic diagonals, as long as the elements are referenced with matrix notation (l,p), where l represents groupings of elements for processing based on the particular mosaic pattern of the display, and p references the order of processing among elements in the group, respectively.

In the following discussion, the references corresponds to the diagonals of the mosaic with isochromatic diagonals as before. In other words, m is one of $m_{total}$ monochromatic diagonals of a mosaic color display, and n is the nth element from the top of the diagonal. Again, the mosaic with isochromatic diagonals is focused on for exemplary purposes, the invention applying to mosaic color patterns in general.

E(m,l) for each diagonal row corresponds to an image element which lies on the physical border of the image. There is no error to be propagated from a prior element since element (m,l) begins a diagonal row. Therefore, as described above, E(m,l) is selected for each of the m diagonal rows. The value can be the same or different for all m diagonal rows. It can also be changed between images.

Figure 11:
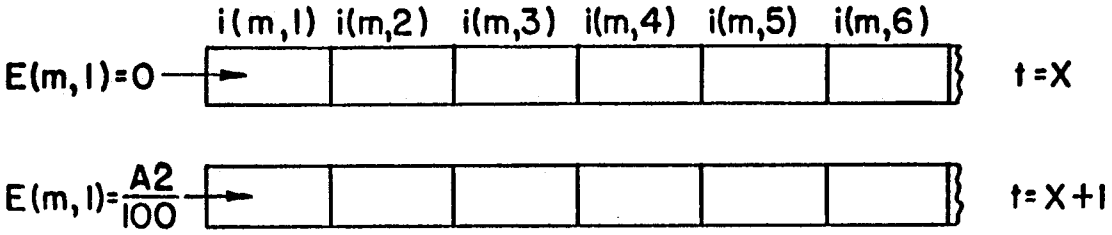
FIG. 11 is a schematic diagram illustrating a change in the preselected error value for the first element in row m for successively processed images.

The consequence of changing the error value for the first element of the mth row E(m,l) for successive frames processed by the present invention is that changes result in any or all of D(m,n) for all m. Referring to FIG. 11, the "row" is drawn horizontally, but may correspond to a diagonal row m of a mosaic color display as in prior Figures, or to any mosaic pattern in general. Assume that the two particular frames are identical, or, at least, the mth row for the two successive frames are identical. Also assumed for this description is that E(m,l) alternates between two values between the minimum and maximum image intensity values for successive frames. Since the values of E(m,l) are different, the error propagated to the successive diagonal elements will in general differ, since the error associated with the (m,n)th element E(m,n)=I(m,n=1-

)+E(m,n−1)−D(m,n−1), and the values of I(m,n) are assumed equivalent between image elements. Furthermore, the mapping of the display element values D(m,n) may differ for corresponding image elements on the two identical frames, since D(m,n) is mapped from the adjusted intensity value of the nth element, I(m,n-)+E(m,n), and E(m,n) differs for the two identical frames. Therefore, it is apparent that a change in E(m,l) can result in changes of any or all of D(m,n) for all m.

The alternating of the nth display element intensity value D(m,n) between two intensity values for successive identical frames is perceived as an average of the two intensitites if the alternating is fast enough. If the threshold level is approximately halfway between two possible display intensity values, then an image element with intensity value I(m,n) near the threshold value is not well represented by either adjacent display intensity value. The alternating between the two adjacent display intensity values, which is more probable in the present method, gives a perceived intensity approximately equal to the threshold level, or the image element intensity value. Furthermore, for those image elements with intensities I(m,n) not bordering on a threshold level, a variation in E(m,l) is less likely to result in a change of display intensity between successive frames. This is also a good result, since if I(m,n) is not near a threshold value, it is relatively close to a possible display level of intensity, Ax, and is well represented by the mapping onto Ax.

The above description can be extended so that the error value of the first element in the mth row E(m,l) changes between more than two values within the range of possible image intensity values for successive frames. For a series of identical frames, as the number of values E(m,l) can take for each image increases, the average intensity of each display element, D(m,n), approaches the value of its corresponding image element intensity, I(m,n). In other words, if 1000 identical frames were procssed and displayed with E(m,l) for each m chosen randomly for each frame and the 1000 frames were processed in a time so short that the eye could not distinguish changes in the display, the display would be perceived as identical to the frame in all respects, most notably its grey-toning.

While the above is the fundamental foundation for the present invention, processing speed is not at the state where such a large number of frames may be processed at a rate undetected by the eye. If E(m,l) changed between 1000 values for the same image at today's processing speeds, the eye would sense the resulting changes in the intensity of the individual display elements along the row m, rather than perceiving the average of the intensities. The particular embodiments described below are attempts to accommodate these two conflicting requirements: changing E(m,l) for successive frames to achieve a more accurate display of intensity over time, while not changing it so much that changes in the displayed image elements are sensed over time for the same input image.

In one embodiment of the invention, the error value for the first element in the mth row E(m,l) for each m are initially uncorrelated to the value for any other m. Each E(m,l) has an initial value between o and the maximum image intensity value. E(m,l) for each m increases incrementally for each successive frame. When E(m,l) exceeds the maximum image intensity value, that maximum is subtracted, and the process continues.

In a more particular embodiment of the invention, the display elements can only take one of two possible intensity values, i.e. r=2 in the general formulation of the invention above. A1 and A2 are normalized to be 0 to 1 respectively, and T1 is chosen to be ½. The image intensity values correspond to those of a TV input and can take one of 256 values between normalized intensities of 0 to 1. For each image, E(m,l) for each m is initially chosen arbitrarily to be either 0 or 0.5. For successive images, E(m,l) for each m alternates between 0 and 0.5. This leads to qualitatively good half toning and is therefore a preferred embodiment.

The advantage of the pel interleaving feature of the present invention can be demonstrated by considering a uniforming dim (not black) region of the analogue image, processed according to the above embodiment. Assuming that the image elements will be less than T1 (or ½) most display elements will be off. If the preload value of the mth row E(m,l)=0, error will gradually accumulate among the elements in row m until I(m,n-)+E(m,n) is greater than T1, and the (m,n)th element is turned "on". However, I(m,n)+E(m,n) is only marginally greater than T1 or ½, while D(m,n)=1; therefore, the error propagated to the (m,n+1) element is approximately −½. Consequently, there will be relatively many "off" pixels adjacent to (m,n) in row m, as the error must accumulate to exceed ½ for another "on" element. The result is evenly-spaced but sparse "on" elements along row m.

If E(m,l) were modulated at the next frame to be E(m,l)=½, the "on" elements of the display would be at the elements equidistantly between the "on" elements of the prior display. This is due to the fact that all elements of the prior frame with an accumulated error of zero would now have error ½, resulting in an "on" pixel, while those prior "on" elements with accumulated error ½, would have an error of 0 resulting in an "off" pixel.

Therefore, if E(m,l) alternated between 0 and ½ for successive identical images, the result of the present invention would be an even temporal and spatial shifting of "on" pixels along the mth row, with the eye perceiving the spatial and temporal average of the "on" elements, rather than sparse, stationary "on" elements on a black background, the result of the time constant preload case.

In another method, the same parameters are chosen as in the embodiment just described. However, E(m,l) for each m is initially chosen randomly between 0 and 1. For successive frames, E(m,l) for each m alternates between its initial value and either (i) a value ½ less than the initial value if the initial value is greater than or equal to ½, or (ii) a value ½ greater than the initial value if the initial value is less than ½.

One further feature of the present invention is a method of artifact suppression, unique to the present invention. Artifact elimination is known to the art for other methods of grey-toning but cannot work with pel interleaving. Artifacts include sparse isolated "on" pixels in regions of the display where the image is dark. These "on" pixels are very noticeable individually and detract from the displayed image quality. Such artifacts are a natural consequence of the error propagation method of the present invention. This is true because even in image regions with intensities well below the first threshold, T1, the error value of adjacent elements will increase as the error is propagated to successive elements. Eventually the adjusted intensity value of the nth element, E(m,n)+I(m,n), will exceed T1, resulting in D(m,n)=A2, or a lit display pixel in a uniformly dark image region.

The present invention eliminates these artifacts by maintaining a record or counter variable, C, of when the last display element in the row was displayed with an intensity greater than Al. If (1) the considered display element is to be mapped with an intensity A2 using the nominal processing algorithm of the present invention and, (2) the record shows that more than a preselect number, N, of display elements of intensity value A1 have been processed since the last element with an intensity value greater than A1, then the display element is mapped with an intensity value Al instead of A2. If both conditions are not met, then the considered display element is mapped with an intensity A2, the result of the nominal processing algorithm of the present invention Of course, whenever the display element is displayed or, using the nominal algorithm, should have been displayed with an intensity greater than Al, the record, C, is reset. Similarly, when the considered display element begins a new row, the record, C, is reset. It should be emphasized that, with the artifact elimination, all processing occurs in the manner as described in detail above. The artifact elimination feature adds one last decision of whether the display element is displayed at A1 or A2.

Other minor facets of the present invention suggest themselves. For example, in one embodiment the display intensity values are equally spaced and the threshold values are spaced equidistantly between neighboring intensity values.

Furthermore, the method of error propagation by pel interleaving could be applied to black and white displays. Then it would not be necessary to propagate diagonally, since horizontally adjacent elements are black and white. Error could be propagated horizontally, and the elements could be referenced so that m corresponds to horizontal rows and n corresponds to vertical columns. Therefore, all i(m,l), ie., the elements for which the error is preselected, would make up the first vertical column of the image.

When image display output is quantized, for example certain liquid crystal displays (LCD's), its output may be quantized in both amplitude and spatial position. A display is quantized in amplitude when its output intensity is limited to certain specific levels, for example in some LCD displays in which the pixel is either on or off, with no intermediate intensity levels (also called bilevel displays). A display is quantized in spatial position when individual areas of the input image are represented by discrete pixels in the display (i.e. the display is pixelated). As discussed above, these quantized display media use a variety of halftoning methods to render an approximation of the contonic imagery.

As described earlier in the present application, it is possible to use temporal techniques to improve the amplitude and spatial resolution of halftoned images such as those created by pel interleaving. The use of time integration to provide error correction maybe referred to as "temporal halftoning". However, the techniques described to this point are primarily directed to the method of linear error propagation.

The basis of the temporal halftoning techniques of the present invention is exploitation of the limited temporal resolution of the human visual system and most quantized display systems. According to the present invention, In successive time periods, the display presents different, equally valid, amplitude quantized renderings of the contone image. These renderings differ from one another in high-spatial-frequency detail alone and act in a coopertive, mutually compensatory manner. A finite number of image renderings may be cycled repeatedly until the contone image input changes, at which time, the process is reinitiated for the new input image.

According to one preferred embodiment of the present invention, $$D(m,n,t_1)=G[\{I(m,b), \text{ all } b<=n\}]$$

$$D(m,n,t_2)=G[\{I(m,b), \text{ all } b<=n\}]$$

where G is the single-branch error diffusion function.

A is the smallest intensity step for a pixel in D $$P(m,b)=0.5*A \text{ for } b=1$$

$$P(m,b)=0 \text{ for } b>1$$

$D(m,n,t_1)$ is the display level at a particular time $t_1$, m is the column and n is the row of the particular pixel.

In order to adapt the technique of temporal halftoning to more general static halftoning schemes such as, for example, the technique described previously wherein the error propagates to more than one adjacent element, it would be advantageous to define a general function for determining the display level D (m,n) in second and subsequent time periods for a particular image. It would be particularly advantageous if the technique described were independent of the static halftoning scheme on which it is based. Such a function may be described by the following formulas. In these formulas an analog image {I(a,b), all a, all b} is well represented by the repetitive sequential display of a set of $Z_0$ digital representations $$\{D(m,n,t_1), D(m,n,t_2) \ldots D(m,n,t_{20})\},$$

by computing the representations as follows:

$$D(m, n, t_z) = F\left(m, n, \left(Z*I(a, b) - \sum_{y=1}^{z-1} D(a, b, t_y), \text{ all } a, \text{ all } b\right)\right)$$

where F is any halftoning function suitable for making a single static rendering, S(m,n) of the analog image, i.e.

$$S(m,n)=F(m,n,\{I(a,b), \text{ all } a, \text{ all } b\}).$$

Of particular interest is the case $Z_0$ equals 2 (which is particularly advantagious in that it avoids temporal artifacts):

$$D(m,n,t_1)=F[m,n,\{I(a,b) \text{ all } a, \text{ all } b\}]$$

$$D(m,n,t_2)=F[m,n,\{2*I(a,b)-D(a,b,t_1) \text{ all } a, \text{ all } b\}]$$

It will be noted that the function F may depend only on particular sets of pixels (for example in the technique described earlier in the present application) or it may represent some calculated value over a number of pixels. To apply the expression above to one-dimensional error diffusion, one can simply use it and take F=G, where G is the one-dimensional error-diffusion function. Under such circumstances, the equation can be simplified (without changing meaning), to:

$$D(m,n,t_1)=G(I(m,b),\ \text{all } b<=n)$$

$$D(m,n,t_2)=G(2\times I(m,b)-D(m,b,t_1),\ \text{all } b<=n)$$

The halftoning function used to calculate a frame is F(x) where x is a function of the level of the original image {I(a,b) all a, all b}. {I(a,b) all a, all b} represents the image level of any or all of the pixels of the original image. The general case {I(a,b)all a, all b} will also include, as a subset, the specific case I(m,n). If the halftoning function F(x) utilizes a one to one dependence between the image and display pels, then the more specific formula for calculating the display level at particular times $t_1$ and $t_2$ would be:

$$D(m,n,t_1)=F[I(m,n,t_1)]$$

$$D(m,n,t_2)=F[2*I(m,n,t_1)-D(m,n,t_1)]$$

"good halftoning functions Ffflx" will assure that $D(m,n,t^1)$ and $D(m,n,t^2)$ do not differ by more than A as defined above for any m and any n. For cases in which this is not true, one can improve the representation of the image by replacing $D(m,n,t^1)$ and $D(m,n,t^2)$ which differ by more than A for a given m and n by their average— $0.5*(D(m,n,t^1)+D(m,n,t^2))$".

It is possible to use conventional electronics to build a machine that implements the algorithm above in real time using the conventional raster-order output of a contone (i.e. finely quantized) image frame buffer. For efficiency, it is useful to note that the computation of D(m,n,tZ) includes many steps carried out in the computation of D(m,n,tz−1) and the use of a memory buffer avoids redoing these computations.

In one special case, using spacial error difusion and $Z_0=2$, a very simple alternate architecutre can be used. A shadow buffer holds the result $D(m,n,t_1)$. That buffer is only $\log_2(g)$ bits deep, where g is the number of display grey levels. Reading it during the generation of $D(m,n,t_2)$ allows one to select from one of g alternate sets of look-up-tables when doing quantization and error propagation. The generation of I(m,n) and 2*I(m,n) for computing $D(m,n,t_1)$ and $D(m,n,t_2)$, respectively, is achieved with simple multiplexing which shifts the presentation of I(m,n) to the quantization adder one bit. (During the generation of $D(m,n,t_1)$ one uses the lookup table used for the generation of $D(m,n,t_2)$ with a zeroed shadow buffer.) Note that by means of enough look-up tables, arbitrary quantization schemes can be realized, such as those which use nonlinear intensity spacing and those which do pseudo-random branching.

While the invention has been particularly shown and described with respect to illustrative and preferred embodiments thereof, it will be understood by those skilled in the art that the foregoing and other changes in form and details may be made therein without departing from the spirit and scope of the invention which should be limited only by the scope of the appended claims.

Having thus described the invention, what is claimed as new, and desired to be secured by Letters Patent is:

1. A method of displaying an image comprising the steps of:

(a) providing an image comprising a plurality of image elements i(m,n), m comprising the integers 1 to $m_{total}$, n comprising the integers 1 to $n_{total}$, $n_{total}$ a function of m, each image element i(m,n) having an intensity I(m,n) equal to at least one of q image intensity values, where q is at least equal to three, each image element having a position;

(b) providing a display comprising a plurality of display elements d(m,n), each having a position corresponding to the position of image element i(m,n), and each display element d(m,n) being capable of emitting light with an intensity D(m,n) equal to one of r amplitude-ordered display intensity values A1,A2 . . . Ar, where r is an integer less than q, and Ax is the xth display intensity value;

(c) storing r−1 threshold values, (T1,T2, . . . T(r−1)), where Tx is the xth threshold value;

(d) storing an error value E(m,n) for each m and n, where E(m,n)=I(m,n−1)+E(m,n−1)−D(m,n−1) and E(m,1) for all m is a function of time and m only;

(e) for mapping the image into the display by displaying the plurality of display elements d(m,n) m=1 to $m_{total}$ and, for each m, for n=1 to $n_{total}$, with an intensity;

(i) D(m,n)=A=1, if I(m,n)+E(m,n)<T1, (ii) D(m,n)=Ar, if I(m,n)+E(m,n)≧T(r−1), or, (iii) for r>2 and T1≦I(m,n)+E(m,n)<T(r−1), D(m,n)=Ax where x is the value between 2 and r−1 which satisfies the condition (T(x−1)≦I(m,n)+E(m,n)<Tx.

2. The method according to claim 1 wherein r=2, whereby, the display is made up of elements with two possible intensity values A1 or A2, and there is only one threshold value T1.

3. A method according to claim 1, comprising the additional steps of:

(a) defining a counter variable C, and a suppression constant, N;

(b) for each m and n considered, (i) if n=1, setting C=N, (ii) if C<0 and D(m,n)=A2, displaying the display element intensity value D(m,n) with an intensity value A1, (iii)

(A) if I(m,n)+E(m,n)≧T1, setting C=N (B) if I(m,n)+E(m,n)<T1, setting C=C−1.

4. The method according to claims 1 or 3 wherein the display intensity values, (A1,A2, . . . Ar), are equally spaced and the threshold values, (T1,T2, . . . T(r−1)), are spaced equidistantly between neighboring intensity values.

5. The method as in claim 1 wherein the image is one of many temporally successive, possibly identical, images provided at a constant frame rate, the display is displayed once for each image, whereby the display is a series of temporally successive images which change at the frame rate.

6. The method as in claim 5 wherein E(m,1) for all m alternates between two different values for each successive image, whereby some or all of the display array elements D(m,n) have different display intensity values for successive but identical images.

7. The method according to claim 6 wherein r=2 and E(m,1) for all m alternates between 0 and T1, whereby some or all of the display elements D(m,n) have different display intensity values for successive but identical images.

8. The method according to claims 1 or 2 wherein the image is provided by the input signal to a CRT video screen, the input signal comprises three overlapping analogue signals corresponding to each primary color intensity of the image, and the display is provided by a display with elements of three or more colors arranged in a mosaic color pattern.

9. The method according to claim 8 wherein I(m,n) is the discrete image element intensity value of the same color of the corresponding display element, determined from the analogue signals for the spatial region of the image corresponding to the display element d(m,n), the spatial region of the image being image element i(m,n).

10. The method according to claim 9 wherein the display is a mosaic color display with isochromatic diagonals and the display elements, d(m,n), correspond to the $n_{total}$ elements in each of the $m_{total}$ isochromatic diagonals of the display, whereby image elements i(m,n) are also referenced diagonally on the image to spatially correspond to display elements d(m,n).

11. The method according to claim 10 wherein the image is one of many temporally successive images provided at a constant frame rate, the display is displayed once for each image, whereby the display is a series of temporally successive, possibly identical, images which change at the frame rate.

12. The method according to claim 11 wherein E(m,1) are equivalent for all m for each said image.

13. The method according to claim 12 wherein E(m,1) for all m change at a frequency equal to that of the frame rate, whereby, some or all of the display array elements D(m,n) have different display intensity values for successive but identical images.

14. The method according to claim 13 wherein r=2, A1=0, T1=A2/z and the value of E(m,1l) for all m alternates at the frame rate between 0 and T1, whereby some or all of the display array elements D(m,n) have different display intensity values for successive but identical images.

15. The method according to claim 11 wherein the value of E(m,1) for each m is uncorrelated to E(m,1) for all other m for each image provided at the constant frame rate, E(m,1) for all m lying between A1 and Ar.

16. The method according to claim 15 wherein E(m,1) for all m change at the constant frame rate, whereby some or all of the display array elements D(m,n) have different display intensity values for successive but identical images.

17. The method according to claim 16 wherein r=2, A1=0, T1=A2/Z, and the values of E(m,1) for each m alternate at the frame rate between two values within the range of 0 and A2 separated by A2/Z , whereby some or all of the display array elements D(m,n) have different display intensity values for successive but identical images.

18. The method according to claim 1 wherein said image and said display are provided with elements of varying intensities of white light.

19. The method according the claim 1 or 18 wherein said image elements i(m,n) correspond to the $n_{total}$ elements in the $m_{total}$ horizontal rows of said provided image, and said display elements d(m,n) correspond to the $n_{total}$ elements in the $m_{total}$ horizontal rows of said provided display.

20. A method of displaying an image comprising the steps of:

(a) providing an image comprising a plurality of image elements i(m,n), m comprising the integers 1 to $m_{total}$, n comprising the integers 1 to $n_{total}$, $n_{total}$ a function of m, each image element i(m,n) having an intensity I(m,n) equal to at least one of q image intensity values, where q is at least equal to three, each image element having a position;

(b) providing a display comprising a plurality of display elements d(m,n), each having a position corresponding to the position of image element i(m,n), and each display element d(m,n) being capable of emitting light with an intensity equal to one of r amplitude-ordered display intensity values A1, A2 . . . Ar, where r is an integer less than q, and Ax is the xth display intensity value;

(c) storing r−1 threshold values (T1,T2, . . . T(r−1)), where Tx is the xth threshold value;

(d) storing defining an error value E(m,n) for each m and n, where $$E(m, n) = \sum_{m'} \sum_{j} K(m, m', n, j) \cdot [I(m', j) + E(m', j) - D(m', j)],$$

where:

(i) m′ ranges among the references for the $m_{total}$ groupings of elements for processing, while j ranges among the references for each element in the m′ group of elements;

(ii) K(m,m′,n,j) is a propagation coefficient for the propagation of error from i(m′,j) to i(m,n);

(iii) E(m,l) is a function of time and m only;

(e) mapping the image onto the display by displaying the plurality or display elements d(m,n) for m=1 to $m_{total}$ and, for each m, for n=1 to $n_{total}$, with an intensity (i) D(m,n)=A1, if I(m,n)+E(m,n)<T1, (ii) D(m,n)=Ar, if I(m,n)+E(m,n)≧T(r−1), or, (iii) for r>2 and T1≦I(m,n)+E(m,n)<T(r−1), D(m,n)=Ax where x is the value between 2 and r−1 which satisfies the condition T(x−1)≦I(m,n)+E(m,n)<Tx.

21. A method according to claim 20, wherein, comprising the additional steps of :

(a) defining a counter variable C, and a suppression constant, N;

(b) for each m and n considered, (i) if n=1, setting C=N, (ii) if C<0 and D(m,n)=A2, displaying the display element intensity value D(m,n) with an intensity value A1, (iii)

(A) I(m,n)+E(m,n)≧T1, setting C=N (B) if I(m,n)+E(m,n)<T, setting C=C−1.

22. The method according to claim 20 wherein the image is provided by the input signal to a CRT video screen, the input signal comprises three overlapping analogue signals corresponding to each primary color intensity of the image, and the display is provided by a display with elements of three or more colors arranged in a mosaic color pattern.

23. The method according to claim 22 wherein I (m,n) is the discrete image element intensity value of the same color of the corresponding display element, determined from the analogue signals for the spatial region of the image corresponding to the display element d(m,n), the spatial region of the image being image element i(m,n).

24. The method according to claim 23 wherein the display is a mosaic color display with isochromatic diagonals and the display elements, d(m,n), correspond to the $n_{total}$ pixels in each of the $m_{total}$ isochromatic diagonals of the display, whereby image elements i(m,n) are also referenced diagonally on the image to spatially correspond to display elements d(m,n).

25. The method according to claim 24 wherein the image is one of many temporally successive images provided at a constant frame rate, the display is displayed once for each image, whereby the display is a series of temporally successive images which change at the frame rate.

26. The method according to claim 25 wherein E(m,1) are equivalent for all m for each said image.

27. The method according to claim 26 wherein E(m,1) for all m change at a frequency equal to that of the frame rate, whereby, some or all the display array elements D(m,n) have different display intensity values for successive but identical images.

28. The method according to claim 27 wherein r=2, A1=0, T1=A2/Z and the value of E(m,1) for all m alternates at the frame rate between 0 and T1, whereby some or all of the display array elements D(m,n) have different display intensity values for successive but identical images.

29. The method according to claim 25 wherein the value of E(m,1) for each m is uncorrelated to E(m,1) for all other m for each image provided at the constant frame rate, E(m,1) for all m lying between A1 and Ar.

30. The method according to claim 29 wherein E(m,1) for all m change at the constant frame rate, whereby, some or all of the display array elements D(m,n) have different display intensity values for successive but identical images.

31. The method according to claim 30 wherein r=2, A1=0, T1=A2/Z, and the values of E(m,1) for each m alternate at the frame rate between two values within the range of 0 and A2 separated by A2/Z, whereby some or all of the display array elements D(m,N) have different display intensity values for successive but identical images.

32. A device for displaying an image comprising:

(a) an input means for receiving in a standard left to right top to bottom raster sequence a plurality of intensity encoded signals I(l,p) corresponding to a plurality of image elements i(l,p) which each correspond to a position on the image, l comprising the integers 1 to $l_{total}$ and corresponding top to bottom to the $l_{total}$ horizontal rows of a raster scan, p comprising the integers 1 to $P_{total}$ and corresponding left to right to the $P_{total}$ vertical columns of a raster scan, where each intensity encoded signal I(l,p) corresponds to at least one of q image intensity values, where q is at least equal to three;

(b) an output means for outputting sequentially a plurality of intensity encoded signals D((l,p) corresponding to a plurality of display elements d(l,p), each display element d(l,p) corresponds to the position of image element i(l,p), and each display intensity encoded signal D(l,p) corresponding to one of r amplitude-ordered display intensity values A1, A2, . . ., Ar, where r is an integer less than q, and Ax is the xth display intensity value;

(c) An error storage means, for storing an error value E(l,p) corresponding to an intensity encoded signal at the input;

(d) A preload buffer for maintaining preselected error values E(1,p) and E(l,1) corresponding to a number of intensity encoded signals at the input;

(e) A processing means for mapping the intensity encoded signal at the input I(l,p) onto the intensity encoded signal at the output D(l,p) by (1) retrieving the value I(l,p) from the input means;

(2) if l=1 or p=1, obtaining the value E(1,p) or E(l,1) from the preload buffer where the obtained value is a function of time and p or time and l, respectively;

(3) if l≠1 and p≠1, obtaining the value E(l,p) from the error storage means, (4) determining the value D(l,p) based on the values of I(l,p) and E(l,p), (5) sending the value D(l,p) to said output means, (6) calculating the value E(l+1, p+1) based on I(l,p), D(l,p) and E(l,p), (7) storing E(l+1, p+1 in said error storage means.

33. A device as in claim 32 wherein said image is provided by the input signal to a CRT video screen, the input signal comprising three overlapping analogue signals corresponding to each primary color intensity of the image, and the display is provided by a display with elements of three or more colors arranged in a mosaic color pattern.

34. A device as in claim 33 wherein I(l,p) is discrete image element intensity value of the same color of the corresponding display element, determined from the analogue signals for the spatial region of the image corresponding to the display element d(l,p), the spatial region of the image being image element i(m,n).

35. A device as in claim 34 wherein the display is a mosaic color display with isochromatic diagonals and the display elements, d(l,p), correspond to the $n_{total}$ elements in each of $l_{total}$ isochromatic diagonals of the display, whereby image elements i(l,p) are also referenced diagonally on the image to spatially correspond to display elements d(l,p).

36. A device as inclaim 32 wherein the processor further includes a threshold determination means for determining whether an intensity encoded signal corresponds to an intensity which is greater than any or all of r−1 threshold values, T1, T2, . . . , T(r−1), where Tx is the xth threshold value.

37. A device as in claim 36 wherein the processor sums the values E(l,p) and I(l,p), accesses the threshold determination means, and determines the value D(l,p) to be (i) D(l,p)=A1, if threshold determination means determines I(l,p)+E(l,p)<T1, (ii) D(l,p)=Ar, if threshold determination means determines I(l,p)≧T(r−1), or, (iii) for r>2 and T1≦I(l,p)+E(l,p)<T(r−1), D(l,p)=Ax, where x is the value between 2 and r−1 which the threshold determination means determines satisfies the condition T(X−1)≦T(l,p)+E(l,p)<Tx.

38. A device as in claims 32 or 37 wherein the processor determines the error value E(l+1, p+1)=I(l,p)+E(l,p)−D(l,p).

39. The device as in claim 32 wherein the error storage means is a line buffer with $p_{total}$ elements.

40. The device as in claim 32 wherein the output means is connected to a video display with pixels arranged in a mosaic color pattern, and capable of displaying r intensity values A1, A2, . . . Ar.

41. A device used for displaying an image comprising:

(a) an input means for receiving in a standard left to right top to bottom raster sequence a plurality of intensity encoded signals I(l,p) corresponding to a plurality of image elements i(l,p) which corresponds to a position on the image, l comprising the integers 1 to $l_{total}$ and corresponding top to bottom to the $l_{total}$ horizontal rows of a raster scan, p comprising the integers 1 to $p_{total}$ and corresponding left to right to the $p_{total}$ vertical columns of a raster scan, where each intensity encoded signal I(l,p) corresponds to at least one of q image intensity values, where q is at least equal to three;

(b) an output means for outputting sequentially a plurality of intensity encoded signals D(l,p) corresponding to a plurality of display elements d(l,p), each display element d(l,p) corresponding to the position of image element i(l,p), and each display intensity encoded signal D(l,p) corresponding to one of r amplitude-ordered display intensity values A1, A2, . . . , Ar, where r is an integer less than q, and Ax is the xth display intensity value;

(c) a partial error storage means for storing partial error values PE(l,l',p,p') corresponding to an intensity encoded signal I(l,p) at the input, from elements (l',p');

(d) a buffer preload means for maintaining preselected error values E(1,p) and E(l,1) corresponding to a number of intensity encoded signals at the input, (e) a processing means for mapping the intensity encoded signal at the input I(l,p) onto the intensity signal at the output D(l,p) by (1) retrieving the value I(l,p) from the input means;

(2) if $l \neq 1$ or $p \neq 1$, obtaining the value E(1,p) or E(l,1) from the buffer preload means, where the obtained value is a function of time and p or time and l, respectively, (3) if $l=1$ and $p=1$, obtaining the values PE(l,l',p,p') from the partial error storage means and summing the values of PE(l,l',p,p') to obtain error value E(l,p), (4) determining the value D(l,p) based on the values of I(l,p) and E(l,p), (5) sending the value D(l,p) to the output means, (6) calculating the partial error values PE(a,l,b,p) where (a,b) are the elements to which error is propagated from (l,p), (7) storing said partial error values PE(a,l,b,p) in said partial error storage means for all (a,b).

42. The device as in claim 41 wherein the error storage means is one or more line buffers, each with a capacity equal to the number of pixels in a horizontal row.

43. A device used for displaying an image comprising:

(a) an input means for receiving in sequence a plurality of intensity encoded signals I(l,p) corresponding to a position on the image, l comprising the integers 1 to $l_{total}$ and referencing the $l_{total}$ groupings of elements for processing, p comprising the integers 1 to $p_{total}$ and referencing the elements in the lth group according to their sequence of processing, $p_{total}$ a function of l, where each intensity encoded signal I(l,p) corresponds to at least one of q image intensity values, where q is at least equal to three;

(b) a matrix sotrage means where the input image intensity values of a complete frame may be stored and accessed;

(c) an output means for outputting sequentially a plurality of intensity encoded signals D(l,p) corresponding to the position of input image intensity value I(l,p) each display intensity encoded signal D(l,p) corresponding to one of r amplitude-ordered display intensity values A1, A2 . . . Ar where r is an integer less than q, and Ax is the xth display intensity value;

(d) a partial error storage means for storing partial error values PE(l,l',p,p') corresponding to an intensity encoded signal I(l,p) being processed from elements I(l',p');

(e) a buffer preload means for maintaining preselected error values E(1,p) and E(l,l) corresponding to a number of intensity encoded signals processed;

(f) a processing means for mapping the intensity encoded signals I(l,p) onto the intensity signal at the output by (1) retrieving a value I(l,p) from the matrix storage means, (2) if $l=1$ or $p=1$, obtaining the value E(1,p) or E(l,1) from the buffer preload means, where the obtained value is a function of time and p or time and l, respectively, (3) if $l=1$ and $p=1$, obtaining the values PE(l,l',p,p') from the partial error storage means and summing the values of PE(l,l',p,p') to obtain error value E(l,p), (4) determining the value D(l,p) based on the values of I(l,p) and E(l,p), (5) sending the value D(l,p) to the output means, (6) calculating the partial error values PE(a,l,b,p), where (a,b) are the elements to which error is propagated from (l,p), (7) storing said partial error values PE(a,l,b,p) in said partial error storage means for all (a,b).

44. The device as in claims 32, 41 or 43 wherein a counter variable C and suppression constant N is defined, and, for each inputted image element intensity value, the processing means further (i) sets $C=N$ if $p=1$, (ii) if $C<0$ and $D(l,p)=A2$, outputs the intensity value A1 to output means for display element intensity value D(l,p), (iii) sets $C=N$ if $I(l,p)+E(l,p) \geqq T1$, (iv) set $C=C-1$ if $I(l,p)+E(l,p)<T1$.

45. The method according to claim 1 or 20, wherein the display is a mosaic color display and the error value E(m,n) propagates to the nearest display element of the same color.

46. A method of displaying a fixed analog image comprising: generating a series of temporally successive, non-identical digital representations on a display comprising an array of display elements, particular display array elements having different display intensity values for each digital representation according to a different predetermined halftone function;

a particular one of said display elements having a display intensity D(m,n) for a particular halftoning function F(x)

said display element having a display intensity calculated at first time $t_1$ of:

$$D(m,n,t_1)=F[I(m,n,t_1)]$$

said display elements having a display intensity, calculated at a second subsequent time $t_2$, of:

$$D(m,n,t_2)=F[2*I(m,n,t_1)-D(m,n,t_1)]$$

wherein, said image has an intensity value of:

I(a,b) all a, all b for image element i(a,b).

47. A method of displaying a fixed analog image comprising: generating a series of temporally successive, non-identical digital representations on a display comprising an array of display elements, particular display array elements having different display intensity values for each digital representation according to a different predetermined halftone function;

one of said particular display elements having a display intensity D(m,n) for a particular halftoning function F(x) wherein:

said display element has a display intensity calculated at first time $t_1$, of:

$$D(m,n,t_1)=F[I(m,n)]$$

said display element having a display intensity, calculated at a second, subsequent time $t_2$ of:

$$D(m,n,t_2)=F(2*I(m,n,t_1)-D(m,n,t_1))$$

wherein, said image has an intensity value of I(m,n).

48. A method of displaying a fixed analog image comprising: generating a series of temporally successive, non-identical digital representations on a display comprising an array of display elements, particular display array elements having different display intensity values for each digital representaion according to a different predetermined halftone function;

a particular one of said display elements having a display intensity D(m,n) for a particular halftoning function F(x) wherein:

said display element having a display intensity calculated at first time $t_1$, of:

$$D(m,n,t_1)=G[(I(m,b), \text{ all } b<=n)]$$

said display element having a display intensity, calculated at a second time $t_2$, of:

$$D(m,n,t_2)=G[(I(m,b)+P(m,b), \text{ all } b<=n)]$$

wherein G is the single-branch error diffusion method, and $$P(m,b)=0.5*A \text{ for } =1$$

$$P(m,b)=0 \text{ for } >1$$

where A is the smallest intenstity step for a pixel and said image has a value of:

I(a,b) all a, all b.

49. A method of displaying an image comprising the steps of:

(a) providing an image comprising a plurality of image elements i(a,b) a comprising the integers 1 to $a_{totals}$, b comprising the integers 1 to $b_{totals}$, each image element i(a,b) having an intensity I(a,b) equal to at least one of q image intensity values, where q is at least equal to three, each image element having a position;

(b) providing a display comprising a plurality of display elements d(m,n), each having a position corresponding to the position of image element i(m,n), and each display element d(m,n) being capable of emitting light with an intensity D(m,n) equal to one of r amplitude-ordered display intensity values A1, A2 . . . Ar, where r is an integer less than q, and Ax is the xth display intensity value;

(c) mapping the image on the display by displaying the plurality of display element d(m,n) at a time $t_1$ with an intensity:

$$D(m,n,t_1)=F[m,n,\{I(a,b) \text{ all } a, \text{ all } b\}],$$

and at a time $t_2$ with an intensity:

$$D(m,n,t_2)=F[m,n,\{2*I(a,b)-D(a,b,t_1) \text{ all } a, \text{ all } b\}],$$

where F is a halftoning function F(x) where x is a function of {I(a,b) all a, all b}, m and n. --

50. A method of displaying a fixed analog image comprising: generating a series of temporally successive, non-identical digital representations on a display comprising an array of display elements, particular display array elements having different display intensity values for each digital representation according to a different predetermined halftone function; one of said particular display elements has a display intensity D(m,n) for a particular halftoning function F(x) at any time $t_z$ of:

$$D(m, n, t_z) = F\left(m, n, \left\{ Z*I(a, b) - \sum_{y=1}^{z-1} D(a, b, t_y), \text{ all } a, \text{ all } b \right\}\right)$$

where Z is an integer of one or greater; where F is a halftoning function suitable for making a single static rendering, S(m,n) of the analog image, and $$S(m,n)=F(m,n,\{I(a,b), \text{ all } a, \text{ all } b\}).$$

* * * * *